US007079161B2

(12) United States Patent
Sagano et al.

(10) Patent No.: US 7,079,161 B2
(45) Date of Patent: Jul. 18, 2006

(54) IMAGE DISPLAY APPARATUS

(75) Inventors: Osamu Sagano, Tokyo (JP); Naoto Abe, Tokyo (JP); Kohei Inamura, Kanagawa (JP); Hiroshi Saito, Kanagawa (JP); Takeshi Ikeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 435 days.

(21) Appl. No.: 10/164,400

(22) Filed: Jun. 10, 2002

(65) Prior Publication Data

US 2003/0006976 A1 Jan. 9, 2003

(30) Foreign Application Priority Data

Jun. 14, 2001 (JP) ..... 2001-180897
Nov. 22, 2001 (JP) ..... 2001-357275

(51) Int. Cl.
*G09G 5/10* (2006.01)
*G09G 5/00* (2006.01)

(52) U.S. Cl. ..... 345/690; 345/204; 345/75.2; 345/77

(58) Field of Classification Search ..... 345/76–84, 345/690, 204, 74.1–75.2
See application file for complete search history.

(56) References Cited

U.S. PATENT DOCUMENTS 5,457,474 A * 10/1995 Ikeda ..... 345/92
5,734,361 A 3/1998 Suzuki et al. ..... 345/74
6,563,478 B1 * 5/2003 Aoki ..... 345/58
6,842,160 B1 1/2005 Yamazaki et al. ..... 345/76
2001/0015835 A1 8/2001 Aoki ..... 358/525
2002/0089473 A1 7/2002 Yamazaki et al. ..... 345/75.2

FOREIGN PATENT DOCUMENTS

| | | |
|---|---|---|
| JP | 02-257553 | 10/1990 |
| JP | 8-248920 | 9/1996 |
| JP | 09-134145 | 5/1997 |
| JP | 2000-242208 | 9/2000 |
| JP | 2001-343954 | 12/2001 |
| JP | 2002-221933 | 8/2002 |

* cited by examiner

*Primary Examiner*—Regina Liang
*Assistant Examiner*—Duc Q Dinh
(74) *Attorney, Agent, or Firm*—Fitzpatrick, Cella, Harper & Scinto

(57) ABSTRACT

There is here provided an image display apparatus that adjusts a change of a drive condition resulting from an electrical resistance of a matrix wiring of a display panel scarcely using a hardware.

The apparatus has an adjusted image data calculation unit that generates adjusted image data that is the image data to which adjustment is applied for relaxing an influence of a voltage drop caused by the electrical resistance of a row wiring for the input image data of one horizontal scan interval, wherein the adjusted image data calculation unit is provided with means for discretely forecasting and calculating a voltage drop amount in the space and time directions, to be generated on the row wiring during the one horizontal scan interval corresponding to input image data and means for calculating the adjusted image data in which adjustment is applied to the image data.

8 Claims, 29 Drawing Sheets

EMISSION CURRENT PULSE WHEN NO VOLTAGE DROP TAKES PLACE

ACTUAL EMISSION CURRENT PULSE

ADJUSTED

ADJUSTED EMISSION CURRENT PULSE

IE : EMISSION CURRENT WHEN NO VOLTAGE DROP TAKES PLACE

IE : EMISSION CURRENT WHEN NO VOLTAGE DROP TAKES PLACE

EMISSION CURRENT PULSE WHEN NO VOLTAGE DROP TAKES PLACE

ACTUAL EMISSION CURRENT PULSE

ADJUSTED EMISSION CURRENT PULSE $$CA=((Xn+1-x)*CData[k][n]+(x-Xn)*CData[k][n+1])/(Xn+1-Xn)$$

$$CB=((Xn+1-x)*CData[k+1][n]+(x-Xn)*CData[k+1][n+1])/(Xn+1-Xn)$$

$$CD=CA*(Dk+1-data)+CB*(data-Dk)/(Dk+1-Dk)$$

IMAGE DISPLAY APPARATUS

BACKGROUND OF THE INVENTION

1. Field of the Invention

The present invention relates to an image display apparatus with a device for forming an image such as an electron-emitting device wired in a matrix, and more particularly, it relates to an image display apparatus such as a television receiver and a display unit that is provided with a phosphor screen which receives an electron beam ejected from an image-forming apparatus and emits light, or which receives a television signal and a display signal of a computer or the like and displays an image by emitting light of itself.

2. Related Background Art

An image display apparatus provided with a cool-cathode device and configuration in which, to adjust a decrease of brightness resulting from a voltage drop by wiring resistance such as an electrical connection wiring to the cold-cathode device, the adjusted data is calculated by statistical operation and requested and adjusted values of an electron beam are combined is disclosed in Japanese Patent Application Laid-Open No. 8-248920.

The configuration of the image display apparatus described in this publication is shown in FIG. 26.

The configuration according to the data adjustment in this apparatus is roughly as follows.

First, 1-line brightness data of a digital image signal is added by an adder 208 and adjusted factor data that corresponds to this added value is read from a memory 207.

On the other hand, after the digital image signal is converted serially/in parallel in a shift register 204 and held in a latch 205 in a predetermined time, it is input to a multiplier 208 provided for each column wiring in a predetermined timing.

The brightness data and the adjusted data read from the memory 207 are multiplied in the multiplier 208 for each column wiring and the adjusted data obtained is transferred to a modulation signal generator 209. A modulation signal that corresponds to the adjusted data is generated in the modulation signal generator 209 and an image is displayed on a display panel based on this modulation signal.

Hereupon, like the addition processing of the 1-line brightness data of the digital image signal in the adder 208, such statistical operation processing that calculates the sum and the average for the digital image signal is performed and adjustment is performed based on this value.

In the aforementioned conventional configuration, there have been required large-scale hardwares such as a multiplier for each column wiring, a memory for outputting adjusted data, and an adder for assigning an address signal to the memory.

The present invention has been made to solve the problem of such prior art, and the object is to provide an image display apparatus that can adjust a change of a drive condition of each device due to the electrical resistance that a matrix wiring of a display panel has using less hardware than before.

SUMMARY OF THE INVENTION

To attain this and other objects, the present invention is an image display apparatus that has an image-forming device that is arranged in a matrix, driven via multiple row and column wirings, and used to form an image, a scan unit that sequentially selects and scans the row wiring, a modulator that is connected to the column wiring and outputs a modulation signal based on adjusted image data in which adjustment that compensates a change of a drive condition for the image-forming device due to the electrical resistance of the row wiring is applied to input image data, and an adjusted image data calculation unit that generates the adjusted image data that is the image data in which the adjustment for relaxing an influence of a voltage drop generated due to the electrical resistance of the row wiring is applied to the input image data of the one horizontal scan interval, wherein the adjustment image data calculation unit has means for discretely forecasting and calculating a voltage drop amount in the space direction and/or time direction to be generated on the row wiring during the one horizontal scan interval corresponding to the input image data, and means that calculates, from the calculated voltage drop amount, the adjusted image data in which the adjustment is applied to the image data.

The present invention is an image display apparatus that has an image-forming device that is arranged in a matrix, driven via multiple row and column wirings, and used to form an image, a scan unit that sequentially selects and scans the row wiring, a modulator that is connected to the column wiring and outputs a modulation signal based on adjusted image data in which adjustment that compensates a change of a drive condition for the image-forming device due to the electrical resistance of the row wiring is applied to input image data, and an adjusted image data calculation unit that generates the adjusted image data that is the image data in which the adjustment for relaxing an influence of a voltage drop generated due to the electrical resistance of the row wiring is applied to the input image data of the one horizontal scan interval, wherein the adjustment image data calculation unit has means for discretely forecasting and calculating a voltage drop amount in the space direction and/or time direction to be generated on the row wiring during the one horizontal scan interval corresponding to the input image data, and means that calculates, from the calculated voltage drop amount, the adjusted input image data in which the adjustment is applied to the image data.

DETAILED DESCRIPTION OF THE PREFERRED EMBODIMENTS

An ideal embodiment of the present invention will be described illustratively next in detail with reference to the drawings. However, the dimensions, material, shape, and relative placement of components described in this embodiment should be changed appropriately according to the configuration and various conditions of an apparatus to which the present invention is applied. The scope of the present invention will not be limited to the following embodiments.

First Embodiment

The two embodiments of the present invention are display apparatuses that arrange electron-emitting devices in a simple matrix. In such display apparatus, a problem occurs that a display image deteriorates because a voltage drop occurs in the wiring resistance of a scan wiring due to the current that flows into the scan wiring and a drive condition of each device changes. The present invention realizes an image display apparatus provided with a processing circuit that adjusts an effect the voltage drop in such scan wiring has on the display image on a comparatively small circuit scale.

An adjustment circuit of this embodiment calculates deterioration of the display image generated due to the voltage drop in accordance with input image data, obtains adjusted data that corrects it, and applies adjustment to the image data.

(Outline of Image Display Apparatus)

Figure 1:
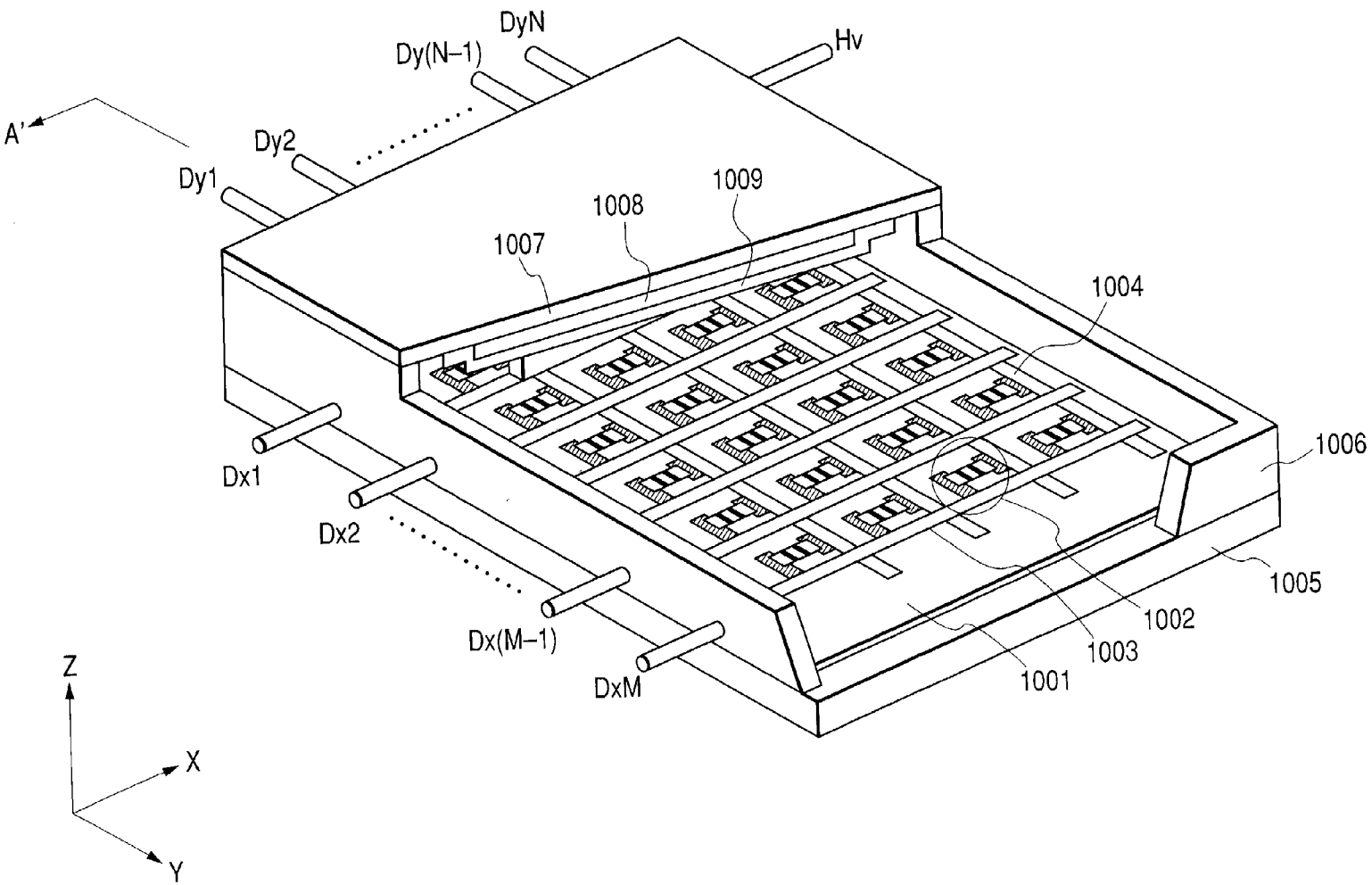
FIG. 1 is a drawing showing an outline of an image display apparatus according to an embodiment of the present invention.

FIG. 1 is a perspective diagram of a display panel using an image display apparatus according to this embodiment and partially cuts and shows the panel to show the internal structure. In the diagram, 1005 is a rear plate, 1006 is a side wall, and 1007 is a faceplate. 1005 to 1007 form an airtight container for maintaining the inside of the display panel in a vacuum.

Figure 2:
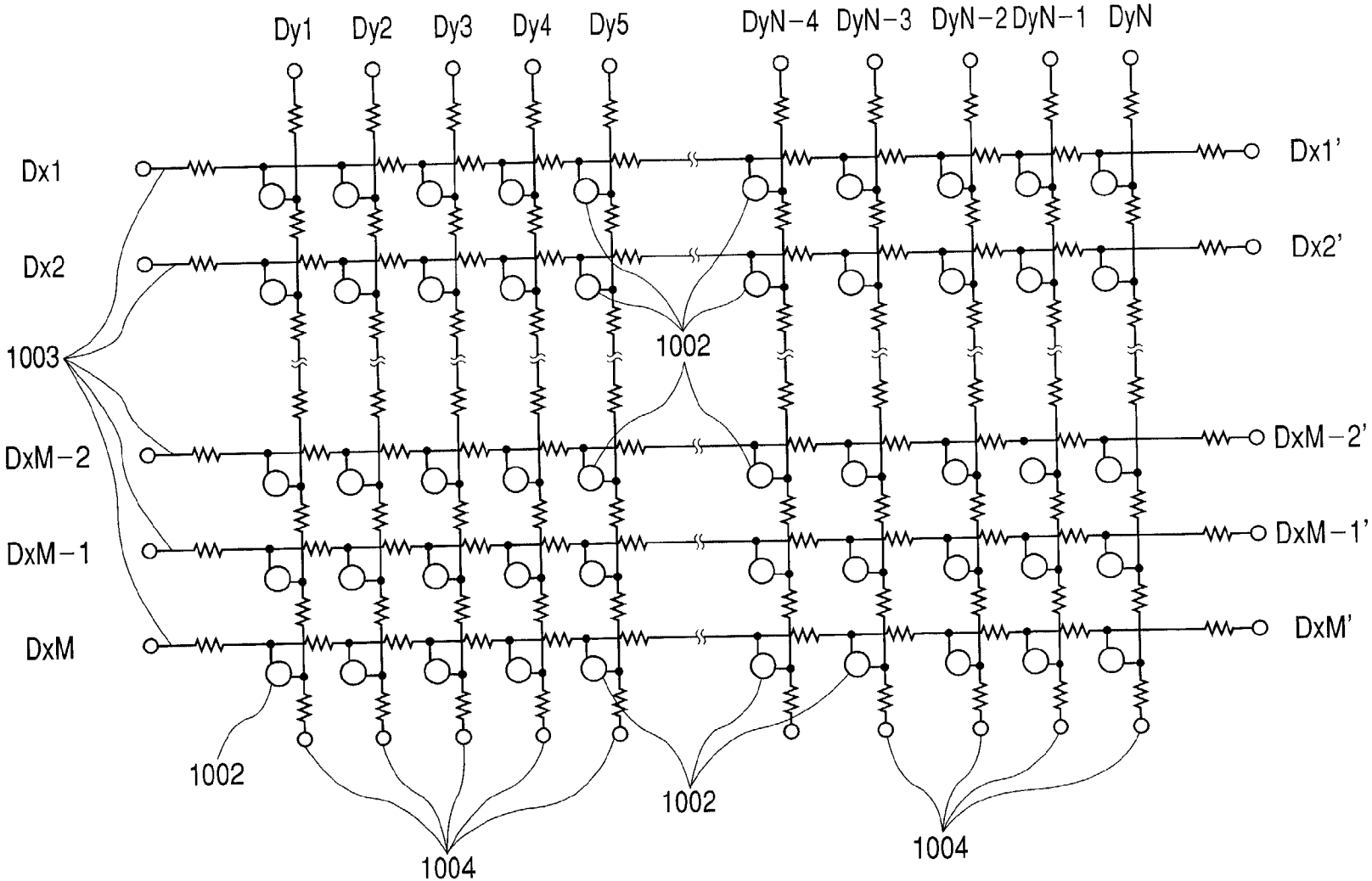
FIG. 2 is a drawing showing the electrical connection of a display panel.

A base plate 1001 is fixed to the rear plate 1005, and N×M units of cold-cathode devices are formed on the base plate. A row wiring (scan wiring) 1003, a column wiring (modulation wiring) 1004, and a cold-cathode device (image-forming device) are connected as shown in FIG. 2.

Such connection structure is called a simple matrix.

A phosphor film 1008 is formed on the bottom surface of the faceplate 1007. Because the image display apparatus according to this embodiment is a color display apparatus, the portion of the phosphor film is coated separately with a phosphor of the three primary colors of red, green, and blue used in the field of a CRT. The phosphor is constructed so that a pixel can be formed for the position where an emission electron (emission current) is irradiated from the cold-cathode device formed in a matrix corresponding to each pixel (picture element) of the rear plate.

A metal-backed film 1009 is formed on the bottom surface of the phosphor film 1008.

Hv is a high voltage terminal and connected electrically to a metal-backed film. A high voltage is applied between a rear plate and a faceplate by applying the high voltage to the Hv terminal.

In this embodiment, a surface conduction electron-emitting device is manufactured in the above display panel as a cold-cathode device. A field-emitting device can also be used as the cold-cathode device. Further, the present invention can be applied to the image display apparatus that is driven by connecting a device that emits light of itself such as an EL device other than the cold-cathode device to a matrix-type wiring.

(Characteristics of Surface Conduction Electron-Emitting Device)

Figure 3:
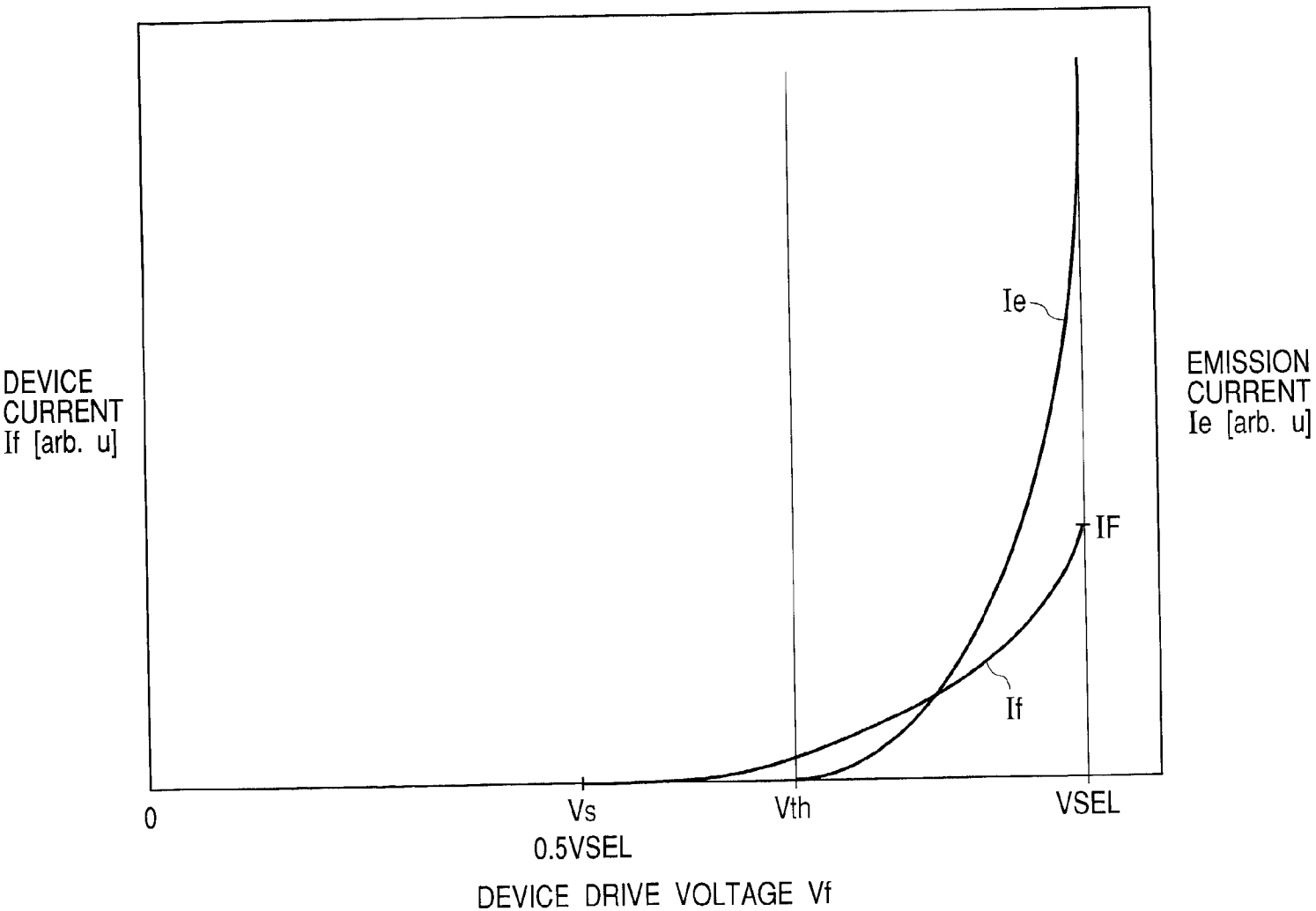
FIG. 3 is a drawing showing characteristics of a surface conduction electron-emitting device.

The surface conduction electron-emitting device has the (emission current Ie) to (device voltage Vf) characteristic and the (device current If) to (device voltage Vf) characteristic, as shown in FIG. 3. Because the emission current Ie is extremely lower than the device current If and difficult to illustrate on the same scale, two graphs are illustrated on each different scale.

The surface conduction electron-emitting device has the following three characteristics regarding the emission current Ie.

In the first place, when the voltage exceeding a certain voltage (this is called threshold voltage Vth) is applied to a device, the emission current Ie increases suddenly. On the other hand, in the voltage of less than the threshold voltage Vth, the emission current Ie is hardly detected.

That is, this device is a nonlinear device that has the definite threshold voltage Vth regarding the emission current Ie.

In the second place, because the emission current Ie changes depending on the voltage Vf applied to the device, the size of the emission current Ie can be controlled by varying the voltage Vf.

In the third place, because the cold-cathode device has a high speed response, the emission time of the emission current Ie can be controlled according to the impression time of the voltage Vf.

The surface conduction electron-emitting device can suitably be used for a display apparatus by using the above characteristics.

For example, in the image display apparatus using the display panel shown in FIG. 1, the display screen can be scanned and displayed sequentially if a first characteristic is used. That is, the voltage exceeding the threshold voltage Vth is appropriately applied to a device that is being driven in accordance with desired emission brightness and the voltage of less than the threshold voltage Vth is applied to a device in the nonselection state. The display screen can be scanned and displayed sequentially by sequentially switching the device that is driven.

The emission brightness of the phosphor can be controlled and an image can be displayed according to the voltage Vf applied to the device by using a second characteristic.

The emission time of the phosphor can be controlled and the image can be displayed according to the time when the voltage Vf is applied to the device by using a third characteristic.

In the image display apparatus of this embodiment, the amount of electron beam of the display panel is modulated using the third characteristic.

(Display Panel Drive Method)

Figure 4:
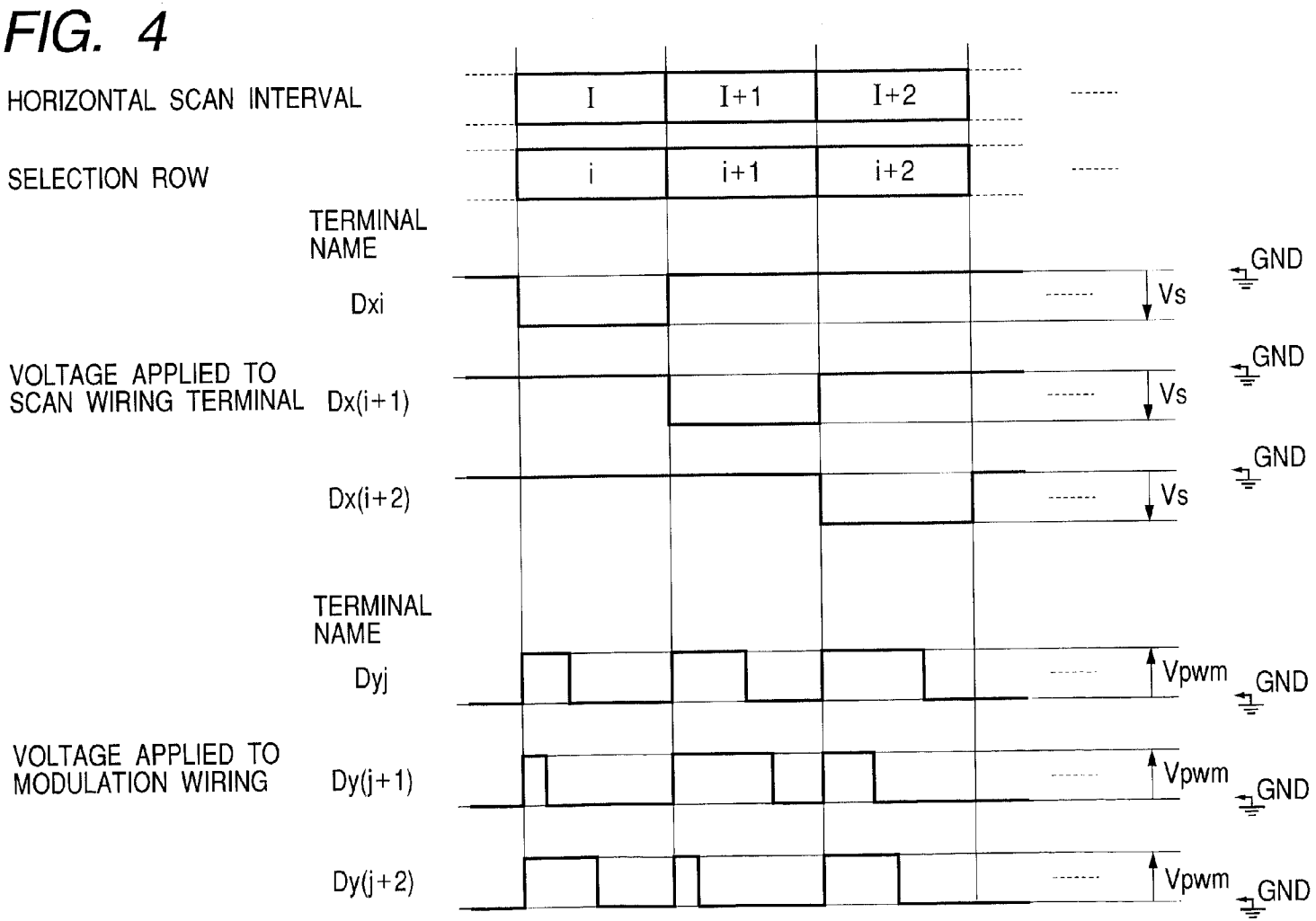
FIG. 4 is a drawing showing a drive method of the display panel.

A drive method of the display panel of the present invention is described specifically with reference to FIG. 4.

FIG. 4 is an example of the voltage applied to a voltage supply terminal of the scan wiring and modulation wiring when the display panel of the present invention is driven.

Now, horizontal scan interval I is an interval at which a pixel of the I-th row is made to emit light.

To make the pixel of the I-th row emit light, the scan wiring of the I-th row is set in the selection state and selection potential Vs is applied to the voltage supply terminal Dxi. Moreover, the voltage supply terminal Dxk (k=1, 2, . . . N, however, k≠i) of other scan wirings is set in the nonselection state and the nonselection potential Vns is applied.

In this example, the selection potential Vs is set to −0.5 $V_{SEL}$ that is half of the voltage $V_{SEL}$ described in FIG. 3 and the nonselection Vns is set to the GND potential.

A pulse width modulation signal of voltage amplitude Vpwm is supplied to the voltage supply terminal of the modulation wiring.

The pulse width of the pulse width modulation signal supplied to the J-th modulation wiring is determined in accordance with the size of the image data of the I-th row and the j-th column pixel of the image to be displayed and the pulse width modulation signal that corresponds to the size of the image data of each pixel is supplied to all modulation wirings when no adjustment is performed in the past.

Besides, in this embodiment, as described later, to adjust the deterioration of brightness due to an influence of a voltage drop, the pulse width of the pulse width modulation signal supplied to the j-th modulation wiring is determined in accordance with the size of the image data of the pixel of the I-th row and the j-th column of the image to be displayed and the adjustment amount and the pulse width modulation signal is supplied to all modulation wirings.

In this embodiment, the voltage of voltage Vpwm is set to +0.5 $V_{SEL}$.

The surface conduction electron-emitting device emits an electron when the voltage $V_{SEL}$ is applied to both ends of the device as shown in FIG. 3, but it does not emit any electron when the applied voltage is a lower voltage than Vth.

The voltage Vth has a characteristic that it is higher than $0.5V_{SEL}$, as shown in FIG. 3.

Accordingly, no electron is emitted from the surface conduction electron-emitting device connected to the scan wiring to which the nonselection potential Vns is applied.

Similarly, in a period (hereinafter referred to as the period in which the output is "L") in which the output of pulse width modulator is ground potential, because the voltage applied to both ends of the surface conduction electron-emitting device on the selected scan wiring is Vs, no electron is emitted.

An electron is emitted from the surface conduction electron-emitting device on the scan wiring to which the selection potential Vs is applied in accordance with a period (hereinafter referred to as the period in which the output is "H") in which the output of pulse width modulator is Vpwm. If the electron is emitted, the aforementioned phosphor emits light in accordance with the amount of emitted electron beam, the brightness can be made to emit light in accordance with an emitted time.

The image display apparatus according to this embodiment also displays an image by sequentially scanning such display panel and modulating a pulse width.

(Voltage Drop in Scan Wiring)

As described above, the fundamental problem of the present invention is that because the potential on the scan wiring increases due to the voltage drop in the scan wiring of the display panel, and, consequently, the voltage applied to the surface conduction electron-emitting device decreases, the emission current from the surface conduction electron-emitting device will decrease. The mechanism of this voltage drop is described below.

The device current for one device of the surface conduction electron-emitting device is approximately several 100 μA when the voltage $V_{SEL}$ is applied though it also depends on the design specification and manufacturing method of the surface conduction electron-emitting device.

Accordingly, when only one pixel on a scan line selected at a horizontal scan interval is made to emit light and other pixels are not made to emit light, the voltage drop hardly takes place and the emission brightness will not decrease because the device current that flows from the modulation wiring into the scan line of the selected line is only the current (that is, the aforementioned several 100 μA) for the one pixel.

When all the pixels of the selected line are made to emit light at a horizontal scan interval, however, the currents for all the pixels flow into the scan wiring that is selected from all modulation wirings. Accordingly, the sum of the currents is several 100 mA to several A and the voltage drop occurred on the scan wiring due to the wiring resistance of the scan wiring.

If the voltage drop occurs on the scan wiring, the voltage applied to both ends of the surface conduction electron-emitting device decreases. Accordingly, the emission current emitted from the surface conduction electron-emitting device decreases. As a result, the emission brightness decreased.

Figure 5A:
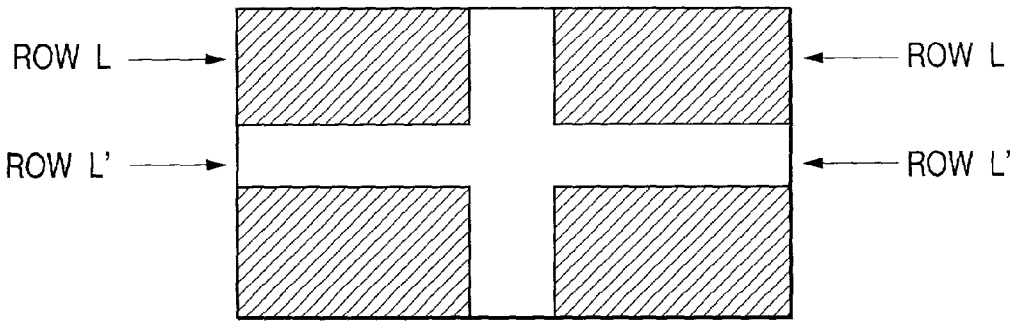
FIGS. 5A and 5B are drawings for describing an influence of a voltage drop.

Specifically, the case where a white cross-shaped pattern is displayed on a black background as shown in FIG. 5A is considered.

Hereupon, because there are a few pixels that turn on when row L of the same drawing is driven, the voltage drop hardly occurs on the scan wiring of the row. As a result, the desired amount of emission current is emitted from the surface conduction electron-emitting device of each pixel and the pixel can be made to emit light in desired brightness.

On the other hand, all pixels turn on at the same time when row L7 of the same drawing is driven. Accordingly, the voltage drop occurs on the scan wiring and the emission current from the surface conduction electron-emitting device of each pixel decreases. As a result, the brightness will decrease on the line of row L'.

Figure 5B:
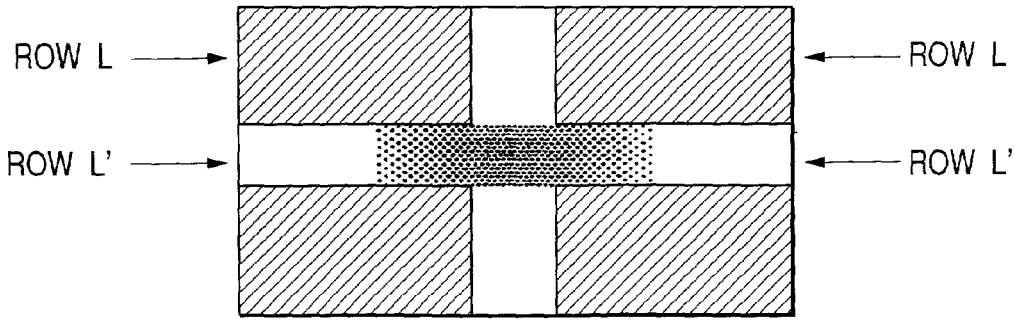

Because the influence received changes due to the voltage drop according to a difference in the image data every horizontal line in this manner, the image as shown in the same FIG. 5B is displayed when the cross-shaped pattern as shown in FIG. 5A is displayed.

Besides, this phenomenon is not limited to the cross-shaped pattern. For example, the phenomenon occurs even when a window pattern and a natural image are displayed.

To be more complicate, the size of the voltage drop has a property of changing even at one horizontal scan interval by performing modulation by pulse width modulation.

Regarding the pulse width modulation signal supplied to each column, the pulse width modulation signal of which the leading edge synchronizes, having the pulse width that depends on the size of input data is output to the input data as shown in FIG. 4. At that time, usually, depending on the input image data, there are many pixels that are turning on in the beginning of the one horizontal scan interval and they turn off sequentially in ascending order of brightness later. Accordingly, the number of pixels that turn on decreases with time during the one horizontal scan interval.

Consequently, the size of the voltage drop that occurs on the scan wiring is also large in the beginning of the one horizontal scan interval and tends to decrease slowly.

Because the pulse width modulation signal changes in the output every time that corresponds to one graduation of modulation, the time of the voltage drop also changes every time that corresponds to the one graduation of the pulse width modulation signal.

The voltage drop in the scan wiring that is the fundamental problem of the present invention is described above.

The method of adjustment for the influence of the voltage drop that is the characteristic of the present invention is described in detail below.

(Voltage Drop Calculation Method)

The inventors considered it necessary that hardware that forecasts the size of the voltage drop and the time change in real time as the first step first to obtain the adjustment amount for decreasing the influence of the voltage drop.

It is general, however, that the display panel of such image display apparatus as the present invention is provided with several thousand of modulation wirings. It is extremely difficult to calculate the voltage drop of the intersection between all modulation wirings and a scan wiring, and it is not actual to manufacture hardware that calculates it in real time.

On the other hand, the present inventors examined the voltage drop. As a result, this proved that there are the following characteristics.

i) In a period of time of one horizontal scan interval, the voltage drop that occurs on the scan wiring is a spatially continuous quantity on the scan wiring and an extremely smooth curve.

ii) Although the size of the voltage drop also differs depending on a display image, it changes every time that corresponds to the one graduation of the pulse width modulation. Roughly speaking, the size is large in the leading edge of a pulse. The size becomes either small slowly or the size is maintained from the standpoint of time. That is, in the drive method shown in FIG. 4, the size of the voltage drop will not increase during the one horizontal scan interval.

Accordingly, the inventors examined that computational complexity cannot be reduced by performing simplification and calculation using the following approximate model in consideration of the aforementioned characteristics.

First, when the size of the voltage drop at a point of time is calculated from the characteristic of i), the inventors examined that several thousand of modulation wirings cannot be calculated by approximately simplifying them by a degradation model that concentrated them into several to several ten modulation wirings (this is described in detail in the calculation of the voltage drop by the following degradation model).

The time change of the voltage drop is roughly forecast by providing multiple times in one horizontal scan interval and calculating the voltage drop for each time from the characteristic listed from ii).

Specifically, the time change of the voltage drop is roughly forecast by calculating the voltage drop for the multiple times by the degradation model described below.

(Calculation of Voltage Drop by Degradation Model)

Figure 6A:
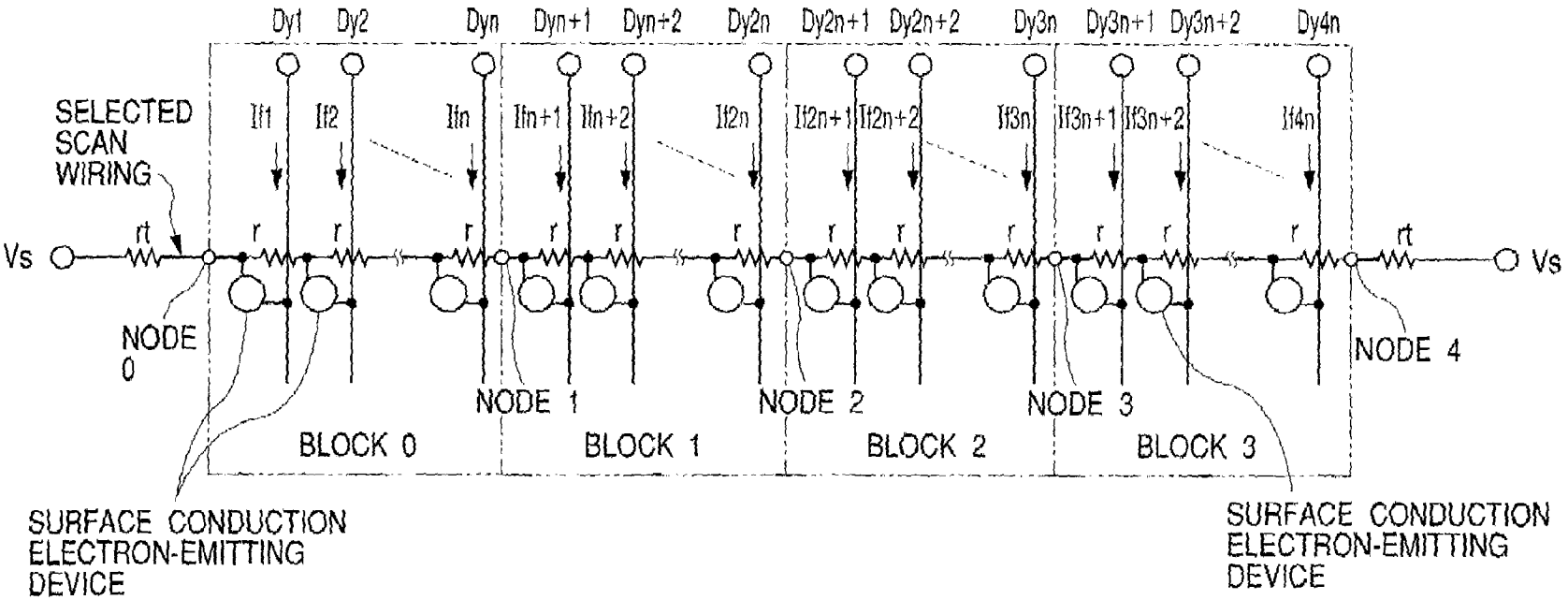
FIGS. 6A, 6B and 6C are drawings for describing a degradation model according to the embodiment of the present invention.

FIG. 6A is a drawing for describing a block and a node when the degradation of the present invention is performed.

In the same drawing, to simplify the drawing, the selected scan wiring, each modulation wiring, and only the surface conduction electron-emitting device connected to the intersection part is described.

Now, it is assumed that the turn-on state (that is, the output of the modulator is "H" or "L") of each pixel on the selected scan wiring is known in a certain time during the one horizontal scan interval.

In this turn-on state, the device current that flows from each modulation wiring into the selected scan wiring is defined as Ifi (I=1, 2, . . . N, i is a column number).

As shown in the same drawing, a block is defined assuming n pieces of modulation wirings, the part that intersects with the modulation wiring of the selected scan wiring, and the surface conduction electron-emitting device arranged in the intersection as one group. In this example, the block is split into four blocks by splitting the block.

The position of a node is set in the boundary position of each block. The node is a horizontal position (reference point) for discretely calculating the voltage drop amount that occurs on the scan wiring in the degradation model. Here, the split block is composed of the surface conduction electron-emitting device connected to the area of the scan wiring split by the node (reference point).

In this example, five nodes of nodes 0 to 4 are set in the block boundary position.

Figure 6B:
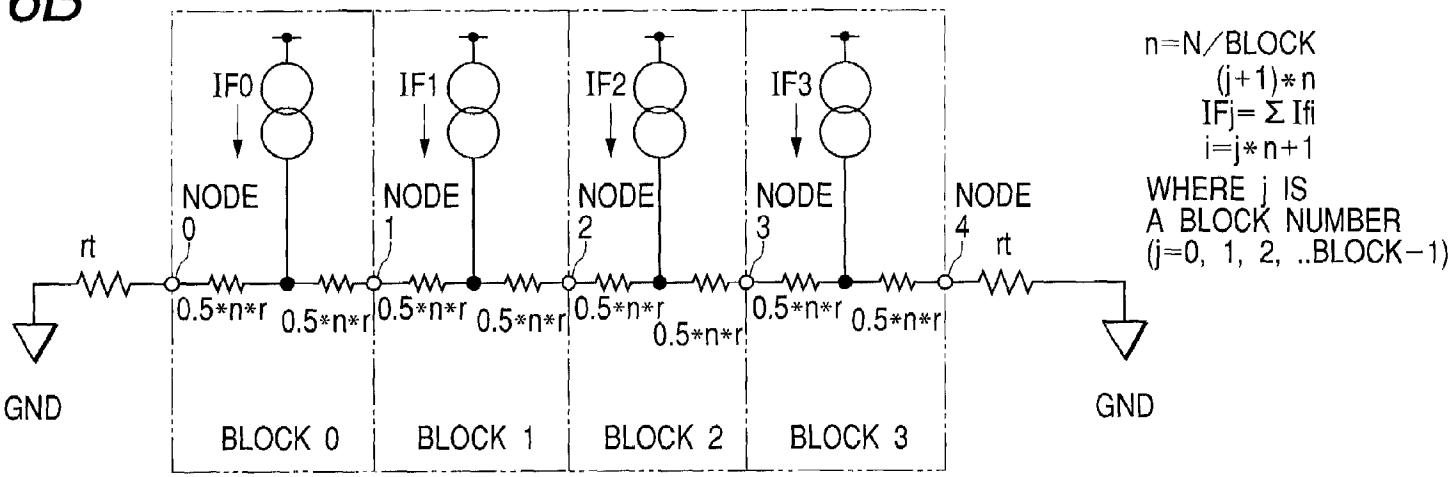

FIG. 6B is a drawing for describing the degradation model.

In the degradation model, the n pieces of modulation wirings contained in the one block of the same FIG. 6A is degraded into one piece (fictitiously assumed to be one wiring) and the wiring is connected to so as to be positioned at the center of the block of the scan wiring.

An attempt is made to connect a current source to the concentrated modulation wiring of each block and cause the sum (statistics) IF0 to IF3 of the current in each block to flow from each current source.

That is, Ifj (j=0, 1, . . . 3) is represented as $$IFj = \sum_{i=j\times n+1}^{(j+1)\times n} Ifi \qquad \text{(Formula 1)}$$

The potential at both ends of the scan wiring is Vs in the example of the same FIG. 6A, while, in the same FIG. 6B, the potential is set in the GND potential. This is because in the degradation model, the current that flows from the modulation wiring to the selected scan wiring is modeled through the above current source, and, consequently, the voltage drop amount of each portion on the scan wiring can be calculated by calculating the voltage (potential difference) of each unit assuming the feed unit as the reference potential.

The surface conduction electron-emitting device is omitted because the voltage drop itself to be generated is not changed regardless of the presence of the surface conduction electron-emitting device if the equivalent current flows from the column wiring when viewed from the selected scan wiring. Accordingly, here, the surface conduction electron-emitting device is omitted by setting the current value that flows from the current source of each block for the current value (Formula 1) of the sum of the device current in each block.

The wiring resistance of the scan wiring of each block is n times the wiring resistance r of the scan wiring for one section (where, the one section indicates the section between the intersection with a column wiring and the intersection with its adjacent column wirings of the scan wiring. In this example, the wiring resistance of the scan wiring for the one section is uniform.

In such degradation model, the voltage drop amounts DV0 to DV4 generated in each node on the scan wiring can simply be calculated according to the following formulas of product-sum formats.

$$DV0=a00\times IF0+a01\times IF1+a02\times IF2+a03\times IF3$$

$$DV1=a10\times IF0+a11\times IF1+a12\times IF2+a13\times IF3$$

$$DV2=a20\times IF0+a21\times IF1+a22\times IF2+a23\times IF3$$

$$DV3=a30\times IF0+a31\times IF1+a32\times IF2+a33\times IF3$$

$$DV4=a40\times IF0+a41\times IF1+a42\times IF2+a43\times IF3$$

That is, $$DVi = \sum_{j=0}^{3} aij \times IFj \qquad \text{(Formula 2)}$$

(I=0, 1, 2, 3, 4)

Where, aij is the voltage generated in the I-th node when the unit current is injected only to the j-th block in the degradation model (hereinafter, this is the definition of aij).

The aforementioned aij can simply be derived according to the Kirchhoff theory as described below.

That is, in FIG. 6B, the wiring resistance as far as the supply terminal at the left of the scan wiring viewed from the current source of block i is defined as rli (I=0, 1, 2, 3, 4), the wiring resistance as far as the supply terminal at the right is defined as rri (I=0, 1, 2, 3, 4), and both the wiring resistance between block 0 and the left supply terminal and the wiring resistance between block 4 and the right supply terminal are defined as rt, it can be seen that $$rl0=rt+0.5\times n\times r$$

$$rr0=rt+3.5\times n\times r$$

$$rl1=rt+1.5\times n\times r$$

$$rr1=rt+2.5\times n\times r$$

$$rl2=rt+2.5\times n\times r$$

$$rr2=rt+1.5\times n\times r$$

$$rl3=rt+3.5\times n\times r$$

$$rr3=rt+0.5\times n\times r \qquad \text{(A)}$$

Further, it can be seen that $$a=rl0//rr0=rl0\times rr0/(rl0+rr0)$$

$$b=rl1//rr1=rl1\times rr1/(rl1+rr1)$$

$$c=rl2//rr2=rl2\times rr2/(rl2+rr2)$$

$$d=rl3//rr3=rl3\times rr3/(rl3+rr3) \qquad \text{(B)}$$

Upon choosing (B), aij is derived as shown below.

$$a00=a\times rt/rl0$$

$$a10=a\times(rt+3\times n\times r)/rr0$$

$$a20=a\times(rt+2\times n\times r)/rr0$$

$$a30=a\times(rt+1\times n\times r)/rr0$$

$$a40=a\times rt/rr0$$

$$a01=b\times rt/rl1$$

$$a11=b\times(rt+n\times r)\mathrm{rl}1$$

$$a21=b\times(rt+2\times n\times r)/rr1$$

$$a31=b\times(rt+n\times r)/rr1$$

$$a41=b\times rt/rr1$$

$a02=c\times rt/rl2$ $a12=c\times(rt+n\times r)/rl2$ $a22=c\times(rt+2\times n\times r)/rl2$ $a32=c\times(rt+n\times r)/rr2$ $a42=c\times rt/rr2$ $a03=d\times rt/rl3$ $a13=d\times(rt+n\times r)/rl3$ $a23=d\times(rt+2\times n\times r)/rl3$ $a33=d\times(rt+3\times n\times r)/rl3$ $a43=d\times rt/rr3$ (C) (Formula 3)

Where, in Formula 3, A//B is the symbol that represents the parallel resistance value of resistor A and resistor B and A//B=A×B/(A+B).

Formula 2 can simply be calculated according to the Kirchhoff theory if the definition of aij is reflected on even when the number of blocks is not 4. Like this example, even when feed terminals are not provided at the opposite sides of the scan wiring and a feed terminal is provided only at one side, it can simply be calculated by calculating aij in accordance with the definition of aij.

Besides, the parameter aij defined according to Formula 3 needs not to be recalculated (because it depends on Teah of the wiring, that is, a physical characteristic)every time calculation is performed. It is calculated once and ought to be stored as a table.

Besides, the approximation shown in Formula 4 is performed to the sum currents IF0 to IF3 of each block defined in Formula 1.

$$IFj=\sum_{i=j\times n+1}^{(j+1)\times n} Ifi = IFS\times\sum_{i=j\times n+1}^{(j+1)\times n}\text{Count } i \quad \text{(Formula 4)}$$

Where, in the aforementioned formula, Counti is a variable set to 1 when the i-th pixel on the selected scan line turns on, and set to 0 when it turns off.

IFS is an amount in which the device current IF that flows when the voltage $V_{SEL}$ is applied to both ends of one device of surface conduction electron-emitting devices is multiplied by the efficient α that obtains a value between 0 and 1.

That is,

IFS is defined as $IFS=\alpha\times IF$ (Formula 5)

Formula 4 represents that the device current flows from the column wiring of each block into the selected scan wiring in proportion to the number of turn-on devices inside the block. On this occasion, the result from which the device current IF of the one device is multiplied by the efficient α is the device current IFS of the one device. This is because it is considered that the scan wiring voltage increases due to the voltage drop, thereby decreasing the amount of the device current.

A convergence calculation is required to exactly figure out the voltage drop amount. That is, voltage drop amount DV1 is figured out by assuming IF which flows under voltages applied when no voltage drop takes place, voltage drop amount DV2 is figured out by assuming IF which flows under voltages applied when voltage drop amount DV1 takes place, . . . , and voltage drop amount DVn is figured out by assuming IF which flows under voltages applied when voltage drop amount DVn−1 takes place. It, however, is a very heavy burden to perform the above calculation in a hardware. Accordingly, for the convergence value of IF, αIF is taken for example as an average of α1 and α2 where α1 represents a reduction rate of IF taken place when the voltage drop amount becomes maximum (all the electron-emitting devices in a line turn on) and α2 represents a reduction rate of IF taken place when the voltage drop amount becomes minimum. In another example, α can be selected as 0.8×α1.

Figure 6C:
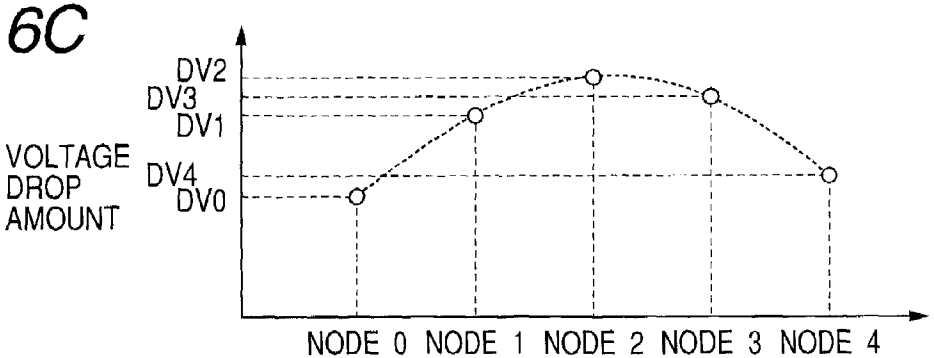

FIG. 6C is an example of the result from which the voltage drop amounts DV0 to DV4 of each node are calculated by the degradation model in a turn-on state.

Because a voltage drop appears as an extremely smooth curve, it is assumed that the voltage drop between the nodes obtains an approximate value as shown in the dotted line of the drawing.

If this degradation model is used in this manner, the voltage drop every node at a desired point of time can be calculated for optional image data.

The voltage drop amount in a turn-on state is simply calculated above using the degradation model.

The voltage drop that occurs on the selected scan wiring changes with time within one horizontal scan interval. This change is forecast, however, by obtaining the turn-on state at that time for several times (reference times) in one horizontal scan interval and calculating the voltage drop for the turn-on state using the degradation model as described above.

Furthermore, the number of turn-on devices inside each block in a period of time at one horizontal scan interval can simply be obtained if the image data of each block is referred to.

Now, it is assumed that the number of bits of input data to the pulse width modulation circuit is 8 bits as one example. The pulse width modulation circuit outputs a linear pulse width to the size of the input data.

That is, when the input data is 0, the output is set to "L". When the input data is 255, "H" is output during one horizontal scan interval. When the input data is 128, "H" is output at the first half interval of the one horizontal scan interval and "L" is output at the later half interval.

In such a case, the number of turn-on devices of the rise time (start time) of the pulse width modulation signal can simply be detected if a number of which the input data to the pulse width modulation circuit is higher than 0 is counted.

Similarly, the number of turn-on devices of the central time of one horizontal scan interval can simply be detected if a number of which the input data to the pulse width modulation circuit is higher than 128.

If image data is compared for a threshold in a comparator and a number of which the output of the comparator is counted, the number of turn-on devices at an optional time can simply be calculated.

To simplify a subsequent explanation, the time amount of a time slot is defined here.

That is, the time slot represents the rise time of the pulse width modulation signal at one horizontal scan interval. It is defined that time slot=0 represents the time immediately after the start time (rise time in this case) of the pulse width modulation signal.

It is defined that time slot=64 represents the time when the time for 64 graduations has elapsed from the start time of the pulse width modulation signal.

Similarly, It is defined that time slot=128 represents the time when the time for 128 graduations has elapsed from the start time of the pulse width modulation signal.

Besides, this example shows the standard of pulse width modulation is the rise time and the pulse width from the time is modulated. Similarly, even when the pulse width is modulated assuming the pulse fall time as the standard, the direction where a time axis advances and the direction where a time slot become reverse. Needless to say, however, this standard can be applied.

(Calculation of Adjusted Data from Voltage Drop Amount)

As described above, the time change of the voltage drop at one horizontal scan interval is able to be calculated approximately and discretely by performing repetitive calculation using the degradation model.

Figure 7:
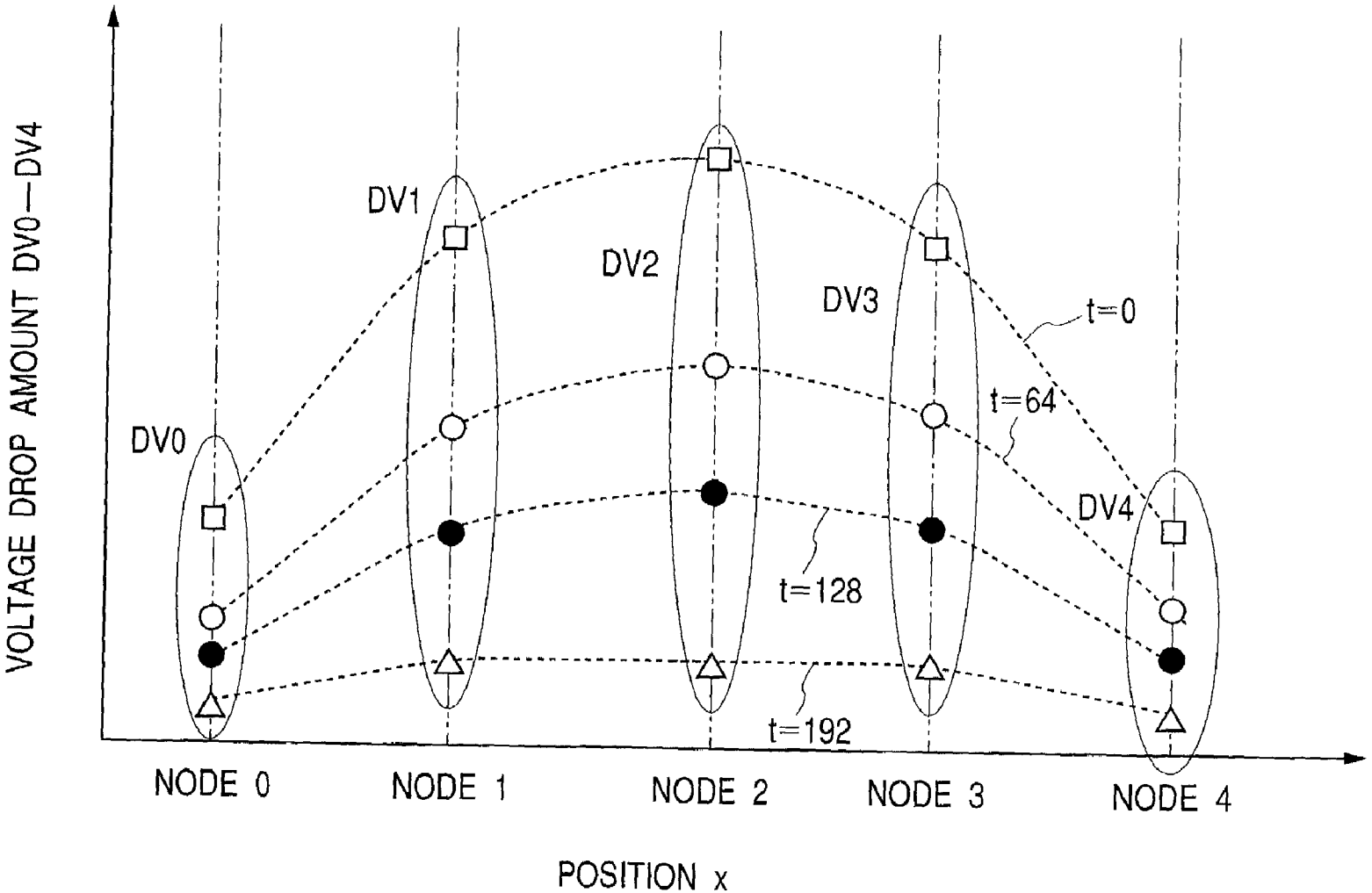
FIG. 7 is a graph showing a discretely calculated voltage drop amount.

FIG. 7 shows an example in which the voltage drop is calculated repetitively for some image data and the time change of the voltage drop in a scan wiring is calculated.

(The voltage drop shown here and the time change show an example for some image data. It is natural that the voltage drop for another image data also makes another change.) In the same drawing, the voltage drop of each time is calculated discretely by applying each degeneration mode at four periods of time of time slot=0, 64, 128, 192 and making calculation.

In FIG. 7, the voltage drop amount in each node is connected with dotted lines, and the dotted lines are described to easily read the drawing. The voltage drop calculated by this degradation model is calculated discretely in the position of each node shown by squares, circles, and triangles.

The inventors examined a method of calculating the adjusted data that adjusts image data from a voltage drop amount as the next stage in which the size of the voltage drop and its time change is able to be calculated.

Figure 8:
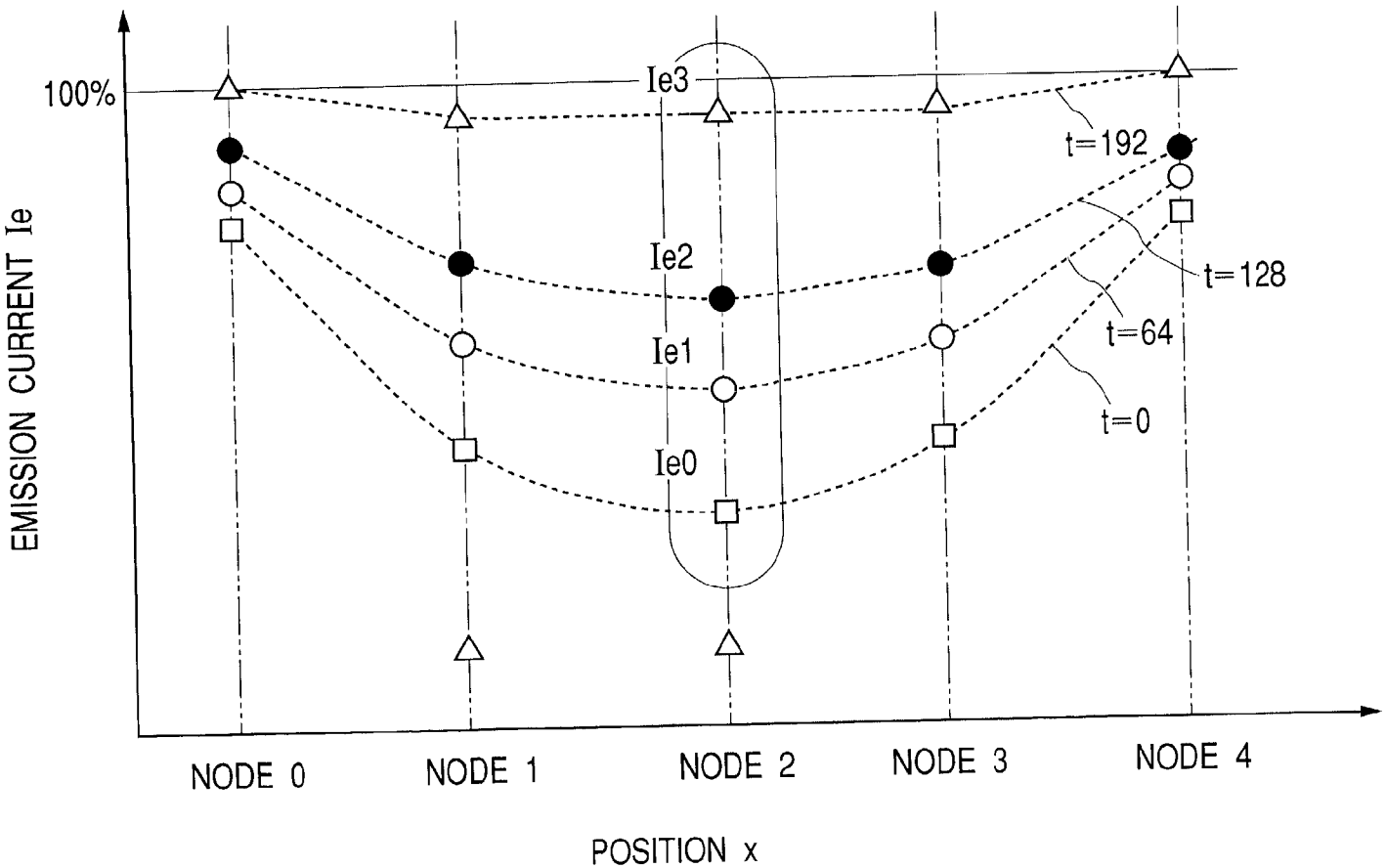
FIG. 8 is a graph showing the variance of a discretely calculated emission current.

FIG. 8 is a graph on which the emission current emitted from the surface conduction electron-emitting device that turns on is estimated when the voltage drop shown in FIG. 7 occurred on the selected scan wiring.

The vertical axis represents the emission current amount of each time and each position in percentage assuming the size of the emission current emitted when no voltage drop takes place as 100% and the horizontal axis represents a horizontal position.

As shown in FIG. 8, in the horizontal position (reference point) of node 2, the emission current at time slot=0 is Ie0, the emission current at time slot=64 is Ie1, the emission current at time slot==128 is Ie2, and the emission current at time slot=192 is Ie3.

The contents of the same drawing are calculated from the graphs of the voltage drop amount of FIG. 7 and the "Drive Voltage to Emission Current" of FIG. 3. Specifically, the emission current value when the voltage at which the voltage drop amount is subtracted from the voltage $V_{SEL}$ is applied is merely plotted mechanically.

Accordingly, the same drawing means the current emitted from the surface conduction electron-emitting device that turns on to the end, and the surface conduction electron-emitting device that turns off will not emit the current.

A method of calculating adjusted data in which image data is adjusted from a voltage drop amount is described below.

Figure 9A:
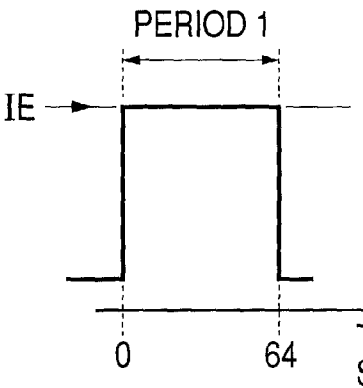
FIGS. 9A, 9B and 9C are drawings for describing a calculation method of adjusted data according to the embodiment of the present invention.
Figure 9B:
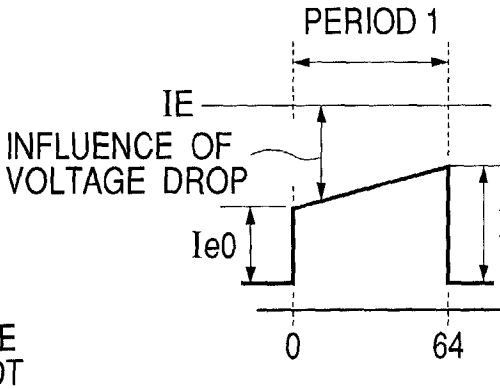
Figure 9C:
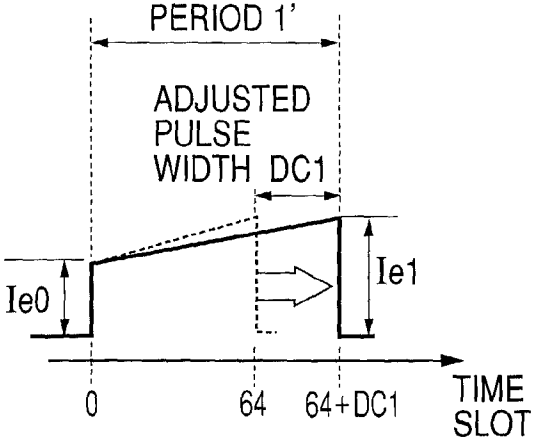

FIGS. 9A to 9C are drawings for describing a method of calculating the adjusted data of the voltage drop amount from the time change of the emission current of FIG. 8. The same drawing is an example in which the adjusted data is calculated for the image data of which the size is 64.

The emission amount of brightness is nothing but an emission charge amount in which the emission current by emission current pulse is integrated with time. Accordingly, subsequently, when the variation of brightness due to the voltage drop is considered, an explanation is made based on the emission charge amount.

Now, if it is assumed that the emission current when the influence of the voltage drop does not take place is IE and the time that corresponds to one graduation of pulse width modulation is Δt, the mission charge amount Q0 to be emitted by the emission current pulse when image data is 64 is obtained by multiplying the amplitude IE of the emission current pulse by a pulse width (64×Δt), the amount can be represented as $$Q0=IE\times 64\times \Delta t \qquad \text{(Formula 6)}$$

In actual, however, a phenomenon occurs in which the emission current decreases by the voltage drop on the scan wiring.

The emission charge amount by the emission current pulse in which the influence of the voltage drop is considered can approximately be calculated as follows.

That is, if the emission current of time slot=0, 64 of node 2 is set to Ie0, Ie1 respectively and the emission current between 0 and 64 approximates to the emission current that changes linearly between Ie0 and Ie1, the emission charge amount Q1 in this meantime can be calculated as the area of the trapezoid of FIG. 9B, that is, $$Q1=(Ie0+Ie1)\times 64\times \Delta t\times 0.5 \qquad \text{(Formula 7)}$$

Next, as shown in FIG. 9C, to adjust a decrease of the emission current due to the voltage drop, when the pulse width is expanded by DC1, it is assumed that the influence of the voltage drop is able to be removed.

When the voltage drop is adjusted and the pulse width is expanded, the emission current amount in each time slot is considered to change. For the purpose of simplification here, as shown in FIG. 9C, the emission current is assumed to be set to Ie0 in time slot=0 and the emission current in time slot=(64+DC1) is assumed to be set to Ie1.

The emission current between time slot 0 and time slot (64+DC1) approximates to a value of the line in which two emission currents are connected with a straight line.

Hereupon, the emission charge amount Q2 by the adjusted emission current pulse can be calculated as $$Q2=(Ie0+Ie1)\times(64+DC1)\times \Delta t\times 0.5 \qquad \text{(Formula 8)}$$

If this Q2 is equal to the aforementioned Q0, it can be seen that $$IE\times 64\times \Delta t=(Ie0+Ie1)\times(64+DC1)\times \Delta t\times 0.5$$

Upon solving this about DC1, it can be seen that $$DC1=((2\times IE-Ie0-Ie1)/(Ie0+Ie1))\times 64 \qquad \text{(Formula 9)}$$

The adjusted data when image data is 64 is calculated in this manner.

That is, the adjustment amount ought to be added by CData=DC1 to the image data of which the size is 64, in the position of node 2, as described in Formula 9.

Figure 10A:
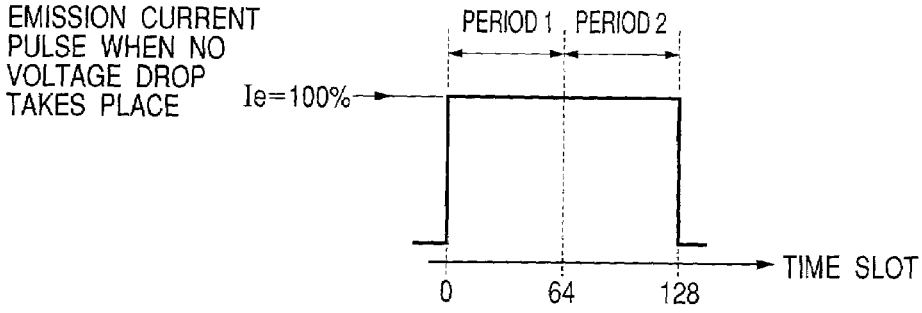
FIGS. 10A, 10B and 10C are drawings showing a calculation example of the adjusted data when the size of image data is 128.
Figure 10B:
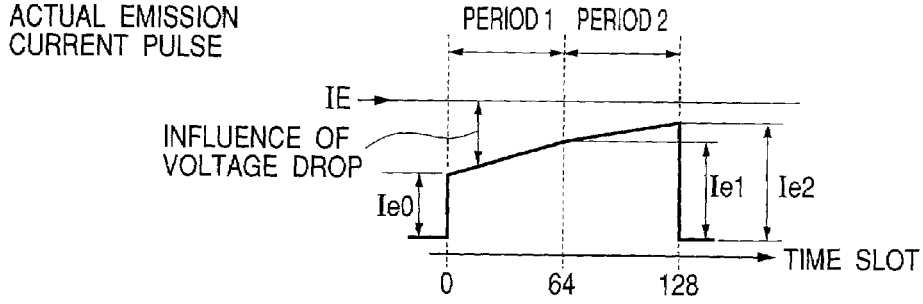
Figure 10C:
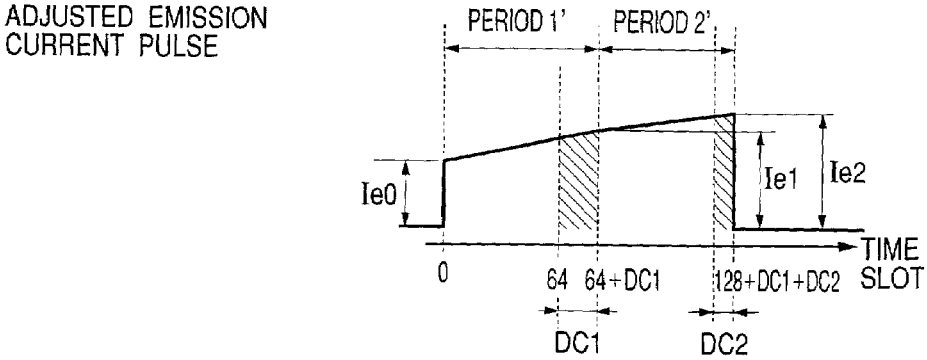

FIGS. 10A to 10C are an example in which the adjusted data for the image data having a size of 128 is calculated from the calculated voltage drop amount.

Now, when the influence of the voltage drop does not take place, the emission charge amount Q3 emitted by the emission current pulse when image data is 128 appears as $$Q3=IE\times128\times\Delta t=2\times Q0 \quad \text{(Formula 10)}$$

On the other hand, the input charge amount by the actual emission pulse affected by the voltage drop can approximately be calculated as follows.

That is, the emission current amounts of time slot=0, 64, 128 of node 2 are assumed to be Ie0, Ie1, Ie2 respectively. Further, if the emission current between 0 and 64 changes linearly between Ie0 and Ie1 and the emission current between 64 and 128 approximates to the emission current that changes on the line connected between Ie1 and Ie2 with a straight line, the emission charge amount Q4 between the time slots 0 to 128 can be calculated as the sum of the area of the two trapezoids of FIG. 4, that is, $$Q4=(Ie0+Ie1)\times64\times\Delta t\times0.5+(Ie1+Ie2)\times64\times\Delta t\times0.5 \quad \text{(Formula 11)}$$

On the other hand, the adjustment amount of the voltage drop is calculated as follows.

The period that corresponds to time slots 0 to 64 is defined as period 1 and the period that corresponds to 64 to 128 is defined as period 2.

When adjustment is applied, it is considered that the portion of period 1 is expanded by DC1 and prolonged to period 1' and the portion of the period 2 is expanded by DC2 and prolonged to period 2'.

When each period is adjusted on this occasion, the emission charge amount is assumed to be equal to the aforementioned Q0.

Needless to say, the emission current at the beginning and end of each period changes by making adjustment. Here, to simplify calculation, the emission current is not assumed to change.

That is, it is assumed that the emission current at the beginning of period 1' is Ie0 and the emission current at the end of period 1' is Ie1. It is also assumed that the emission current at the beginning of period 2' is Ie1 and the emission current at the end of period 2' is Ie2.

Hereupon, DC1 can be calculated in the same manner as Formula 9.

DC2 can be calculated according the same idea as $$DC2=((2\times IE-Ie1-Ie2)/(Ie1+Ie2))\times64 \quad \text{(Formula 12)}$$

As a result, the adjustment amount CData ought to be added to the image data of which the size of the position of node 2 is 128 by $$\text{CData}=DC1+DC2 \quad \text{(Formula 13)}$$

Figure 11A:
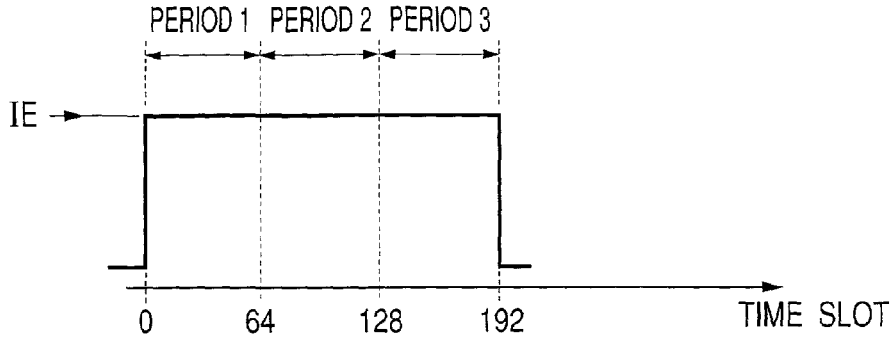
FIGS. 11A, 11B and 11C are drawings showing the calculation example of the adjusted data when the size of image data is 192.
Figure 11B:
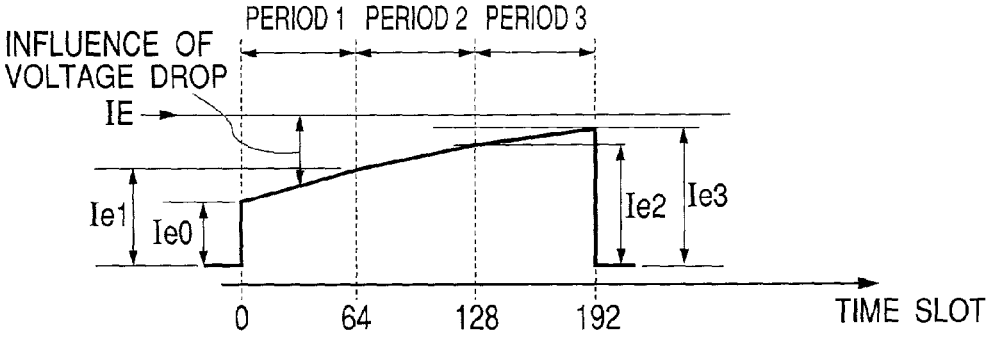
Figure 11C:
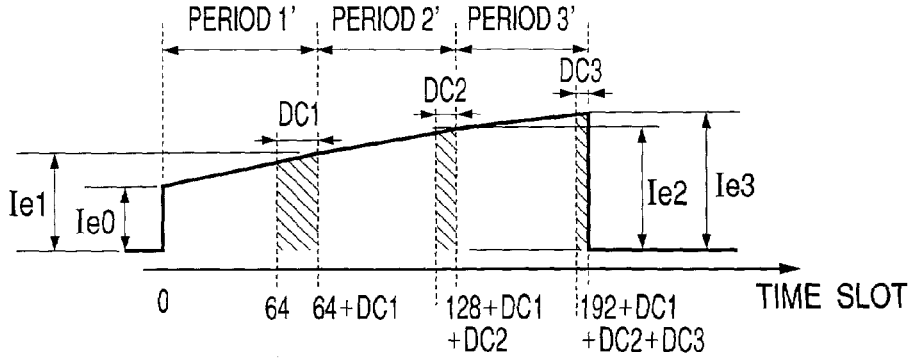

FIGS. 11A to 11C are examples in which the adjusted data for the image data having a size of 192 is calculated from the calculated voltage drop amount.

Now, the emission charge amount Q5 by the emission current pulse anticipated when image data is 192 appears as $$Q5=IE\times192\times\Delta t=3\times Q0$$

On the other hand, the emission charge amount by the actual emission current pulse affected by the voltage drop can approximately be calculated as follows.

That is, the emission current at time slot=0 of node 2 is Ie0 and the emission current at time slot=64 is Ie1. The emission current at time slot=128 is Ie2 and the emission current at time slot=192 is Ie3. The emission current between 0 to 64 changes linearly between Ie0 and Ie1 and approximates to the emission current between 64 and 128 that changes on the line connected between Ie1 and Ie2 with a straight line and the emission current between 128 and 192 that changes on the line connected between Ie2 and Ie3 with a straight line, the input charge amount charge Q6 between time slots 0 and 192 can be calculated as the area of the three trapezoids of FIG. 11C, that is, $$Q6=(Ie0+Ie1)\times64\times\Delta t\times0.5+(Ie1+Ie2)\times64\times\Delta t\times0.5+(Ie2+Ie3)\times64\times\Delta t\times0.5 \quad \text{(Formula 14)}$$

On the other hand, the adjustment amount of the voltage drop is calculated as follows.

The period that corresponds to time slots 0 to 64 is defined as period 1, the period that corresponds to 64 to 128 is defined as period 2, and the period that corresponds to 128 to 192 is defined as period 3.

In the same manner as previously, after adjustment is applied, it is assumed that the portion of period 1 is expanded by DC1 and prolonged to period 1', the portion of period 2 is expanded by DC2 and prolonged to period 2', and the portion of period 3 is expanded by DC3 and prolonged to period 3'.

When each period is adjusted on this occasion, the emission charge amount is assumed to be equal to the aforementioned Q0.

The emission current at the beginning and end of each period is assumed to be invariable before and after the adjustment.

That is, it is assumed that the emission current at the beginning of period 1' is Ie0 and the emission current at the end of period 1' is Ie1. It is also assumed that the emission current at the beginning of period 2' is Ie1 and the emission current at the end of period 2' is Ie2. It is also assumed that the emission current at the beginning of period 3' is Ie 3 and the emission current at the end of period 3' is Ie4.

Hereupon, DC1 and DC2 can be calculated in the same manner as Formulas 9 and 12 respectively.

DC3 can be calculated as $$DC3=((2\times IE-Ie2-Ie3)/(Ie2+Ie3))\times64 \quad \text{(Formula 15)}$$

As a result, $$\text{CData}=DC1+DC2+DC3 \quad \text{(Formula 16)}$$

ought to be added as the adjusted data CData is added to the image data of which the size of the position of nede 2 is 192.

The adjusted data CData of the image data 64, 128, and 192 for the position of nede 2 is calculated in the aforementioned manner.

When the pulse width is 0, because no influence of the voltage drop for the emission current naturally, the adjusted data is set to 0 and the adjusted data CData added to image data is also set to 0.

Besides, the calculation of the adjusted data for disconnectedly skipped image data such as 0, 64, 128 and 192 is to aim at decreasing computational complexity.

That is, if the same calculation is performed for all optional image data, the computational complexity becomes extremely large and the hardware amount for making the computation will become extremely large.

On the other hand, in a node position, as image data becomes larger, the adjusted data also tends to increase. Accordingly, when the adjusted data for the optional image data is calculated, if points at which the adjusted data is already calculated in the vicinity of the image data are interpolated by linear approximation, the computational complexity can greatly be decreased. Besides, this interpolation is described in detail when the discrete adjusted data interpolation unit is described.

If the same idea is applied in all node positions, the adjusted data of image data=0, 64, 128, 192 can be calculated in all the node positions.

In this example, the adjusted data for the four data reference values of 0, 64, 128, 192 is able to be obtained by applying the degradation model to four points of time slots 0, 64, 128, 192 and calculating the voltage drop amount of each time.

Desirably as described previously, however, the time change of the voltage drop can be handled more accurately and an approximate calculation error can be reduced by making a time interval fine at which the voltage drop is calculated by the degradation model and further increasing an image data reference value.

Besides, Formulas 6 to 16 ought to be deformed and calculated based on the same idea on that occasion.

The adjusted data for image data=0, 64, 128, 192 in each node position is calculated discretely for some input data according to the aforementioned method.

Figure 12A:
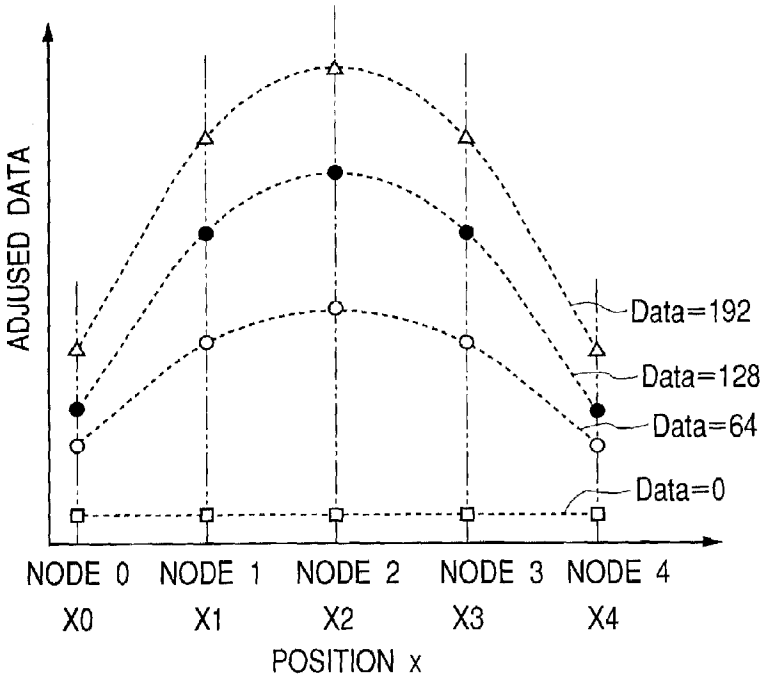
FIGS. 12A and 12B are drawings for describing an interpolation method of the adjusted data according to the embodiment of the present invention.

An example of the discrete adjusted data for some input image data obtained according to this method is shown in FIG. 12A. In the same drawing, the horizontal axis corresponds to a horizontal display position in which the position of each node is positioned. The vertical axis represents the size of adjusted data.

The discrete adjusted data is calculated for the position of the node and the size (image data reference values=0, 64, 128, 192) of the image data Data described with squares, circles, black circles, and triangles of the drawing.

(Discrete Adjusted Data Interpolation Method)

The discrete adjusted data is discrete for the position of each node, but the adjusted data in an optional horizontal position (column wiring number) is not assigned. Simultaneously with this, the adjusted data is assigned for the image data having the size of the reference value of several predetermined image data in each node position and not the adjusted data that corresponds to the size of actual image data.

Accordingly, the inventors calculated the adjusted data that matches the size of input image data in each column wiring by interpolating the adjusted data that is calculated discretely.

Figure 12B:
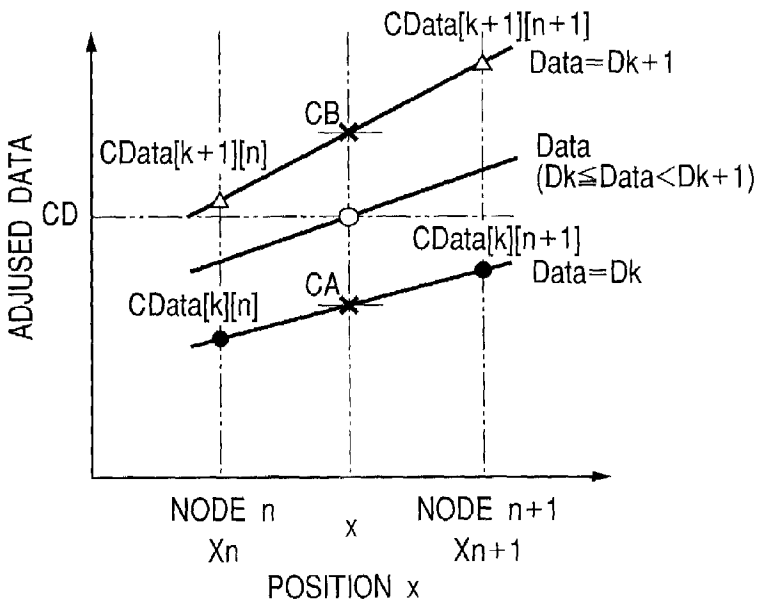

FIG. 12B is a drawing showing the method of calculating the adjusted data that corresponds to image data Data in the position of x between node n and node n+1.

Besides, it is on the assumption that the adjusted data is already calculated discretely in the positions Xn and Xn+1 of the node n and node n+1.

Input image data Data has a value between two image data reference values Dk and Dk+1 for which the adjusted data is already calculated discretely.

Now, if the adjusted data for the reference value Dk of the k-th image data of node n is described as CData [k] [n], the adjusted data CA for the image data Dk in position x can be calculated by linear approximation using values of CData [k] [n] and CData [k] [n+1] as follows.

$$CA = \frac{(Xn+1-x)\times CData[k][n] + (x-Xn)\times CData[k][n+1]}{Xn+1-Xn}(A) \quad \text{(Formula 17)}$$

The adjusted data CB of the image data Dk+1 in position x can be calculated as follows.

$$CB = \frac{(Xn+1-x)\times CData[k+1][n] + (x-Xn)\times CData[k+1][n+1]}{Xn+1-Xn}(B) \quad \text{(Formula 18)}$$

The adjusted data CD for the image data Data in position x can be calculated by linearly approximating the adjusted data CA and CB as follows.

$$CD = \frac{CA\times(Dk+1-Data) + CB\times(Data-Dk)}{Dk+1-Dk}(C) \quad \text{(Formula 19)}$$

As described above, to calculate the adjusted data that matches the actual position and the size of image data from the discrete adjusted data, it can simply be calculated according to the method described in Formulas 17 to 19.

If image data is adjusted by adding the adjusted data calculated in this manner to the image data and pulse width modulation is performed in accordance with the adjusted image data, the deterioration of image quality due to the voltage drop that is the conventional problem can be decreased and image quality can be improved.

Because the hardware for adjustment that is the previous problem can decrease computational complexity by introducing approximation such as degradation that is described above, there is an excellent advantage that the system can be composed of extremely small-scale hardware.

(Function Description of Entire System and Each Portion)

Next, the hardware of the image display apparatus in which the adjusted data calculation unit is contained is described next.

Figure 13:
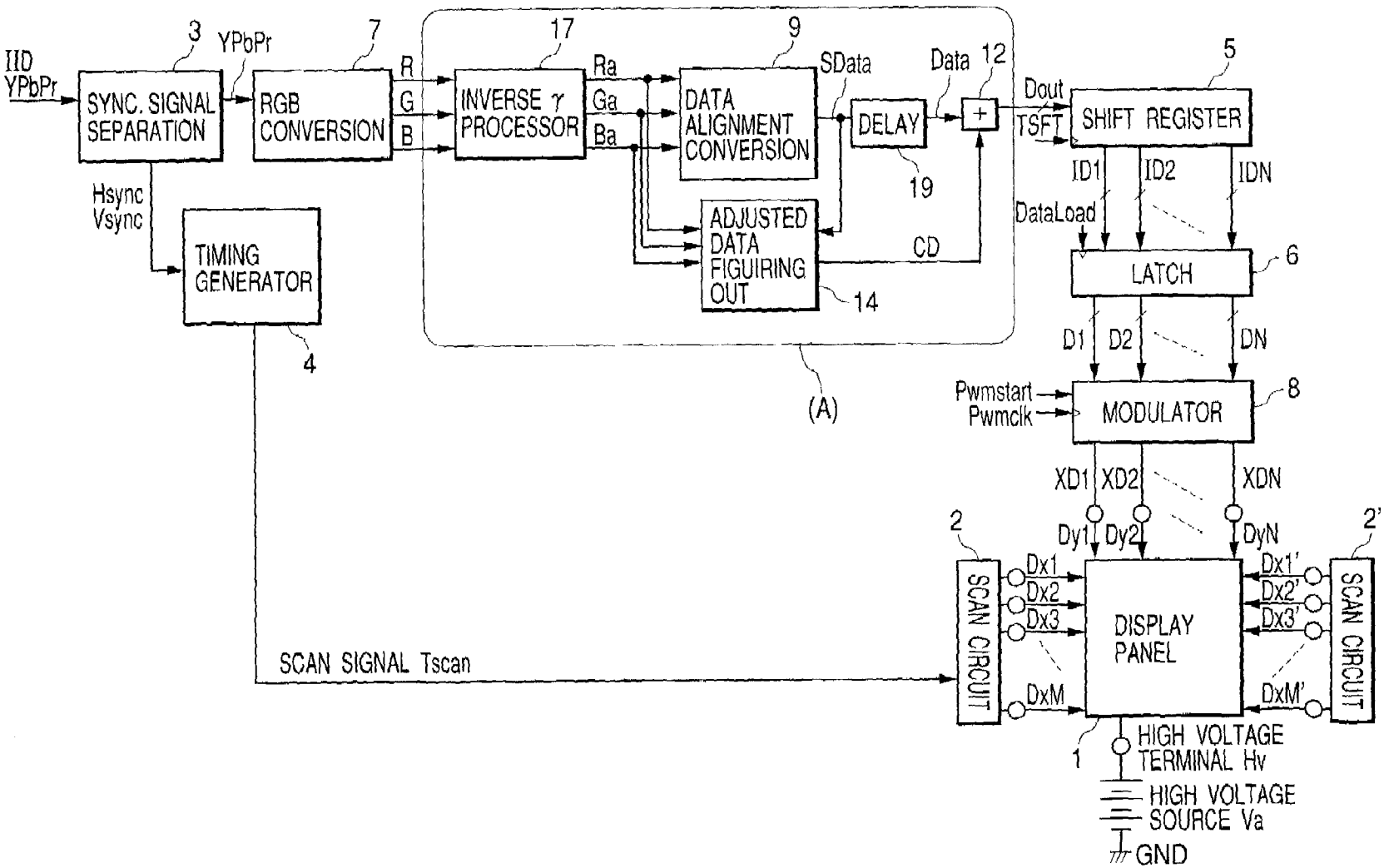
FIG. 13 is a block diagram showing a schematic configuration of the image display apparatus that has a built-in adjustment circuit according to the embodiment of the present invention.

FIG. 13 is a block diagram showing the outline of the circuit configuration. In the diagram, 1 is the display panel of FIG. 1, Dx1 to DxM and Dx1' to DxM' are voltage supply terminals of the scan wiring of the display panel, Dy1 to DyN are voltage supply terminals of the modulation wiring of the display panel, Hv is a high voltage supply terminal for applying an acceleration voltage between the faceplate and rear plate, and Va is a high voltage source. 2 is a scan circuit (scan unit) and 3 is a sync signal separation unit. 4 is a timing generator and 7 is a conversion circuit for converting the YPbPr signal to RGB by the sync separation unit 3. 17 is an inverse γprocessor and 5 is a shift register for one line of image data. 6 is a latch for one line of the image data and 8 is a pulse width modulator (modulator) that outputs a modulation signal to the modulation wiring of the display panel. 12 is an adder (operation processor, addition processor) and 14 is an adjusted data calculation unit.

In the same diagram, R, G, B are RGB-parallel input picture data and Ra, Ga, Ba are the RGB-parallel picture data to which inverse γconversion processing is applied described later. Data is image data converted in parallel/serially by a data alignment conversion unit and CD is adjusted data calculated by the adjusted data calculation unit. Dout is the adjusted image data by adding the adjusted data to the image data by the adder.

(Sync Separation Unit, Timing Generator)

The image display apparatus of this embodiment can display NTSC, a television signal such as PAL, SECAM or HDTV, and VGA that is the computer output at the same time.

FIG. 13 shows only the HDTV system to simplify the drawing.

The picture signal of the HDTV system first separates sync signals Vsync, Hsync by the sync separation unit of 3 and supplied to the timing generator. The sync separated picture signal is supplied to an RGB conversion unit. In addition to the conversion unit from YPbPr to RGB, a lowpass filter and an A/D converter that are not illustrated are provided in the RGB conversion unit and YPbPr is converted to the digital RGB signal and supplied to the inverse γprocessor.

(Timing Generator)

The timing generator contains a PLL circuit. The timing generator generates a timing signal that synchronizes with the sync signals of various picture sources and generates the operation timing signal of each unit.

The timing signals the timing generator 4 generates include Tsft that controls the operation timing of the shift register 5, a control signal Dataload for latching the data from the shift register to the latch circuit 6, pulse width start signal Pwnstart of the modulator 8, clock Pwmclk for pulse width modulation, and Tscan that controls the operation of the scan circuit 2.

(Scan Circuit)

The scan circuit 2 and a scan circuit 2' output selection potential Vs or non-selection potential Vns to connection terminals Dx1 to DxM to sequentially scan the display panel at one horizontal scan interval by one row.

The scan circuits 2 and 2' sequentially switch the selection scan wiring every one horizontal interval and perform scan synchronizing with the timing signal Tscan from the timing generator 4.

Besides, Tscan is a timing signal group created from a vertical sync signal and a horizontal sync signal.

Figure 14:
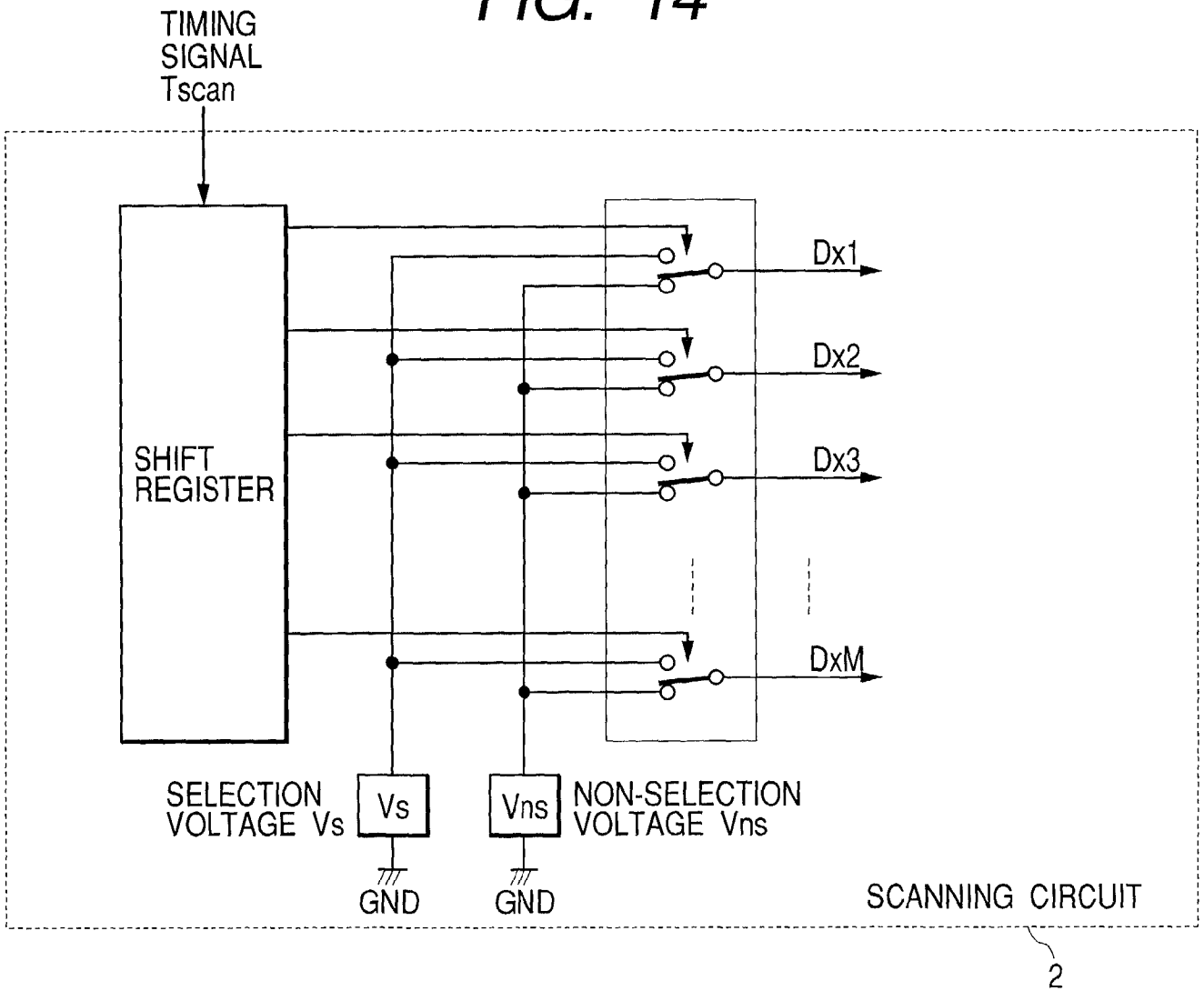
FIG. 14 is a block diagram showing the configuration of a scan circuit of the image display apparatus according to the embodiment of the present invention.

The scan circuits 2 and 2' consist of M pieces of switches and shift registers respectively, as shown in FIG. 14. Desirably, these switches should be composed of transistors and FETs.

Besides, to decrease the voltage drop in the scan wiring, desirably, the scan circuits should be connected to both ends of the scan wiring of the display panel and be driven from both the ends.

On the other hand, the present invention is effective even when the scan circuits are not connected to both the ends of the scan wiring and can be applied only by changing the parameter of Formula 3.

(Inverse γProcessor)

The CRT is provided with almost the 2.2th power emission characteristic (hereinafter referred to as the inverse γcharacteristic) for the input.

Such characteristic of the CRT is considered on the input picture signal, and generally, the input picture signal is converted in accordance with the 0.45th power γcharacteristic so as to obtain a linear emission characteristic when it is displayed on the CRT.

On the other hand, because the display panel of the image display apparatus of this embodiment has almost the linear emission characteristic for the length of application time when modulation is applied according to the impression time of a drive voltage, the input picture signal needs to be converted (hereinafter referred to inverse γconversion) based on the inverse γcharacteristic.

The inverse γprocessor shown in FIG. 13 is a block for inverse-γ-converting the input picture signal.

The inverse γprocessor of this embodiment allows the aforementioned inverse γconversion processor composed of memories.

Figure 15:
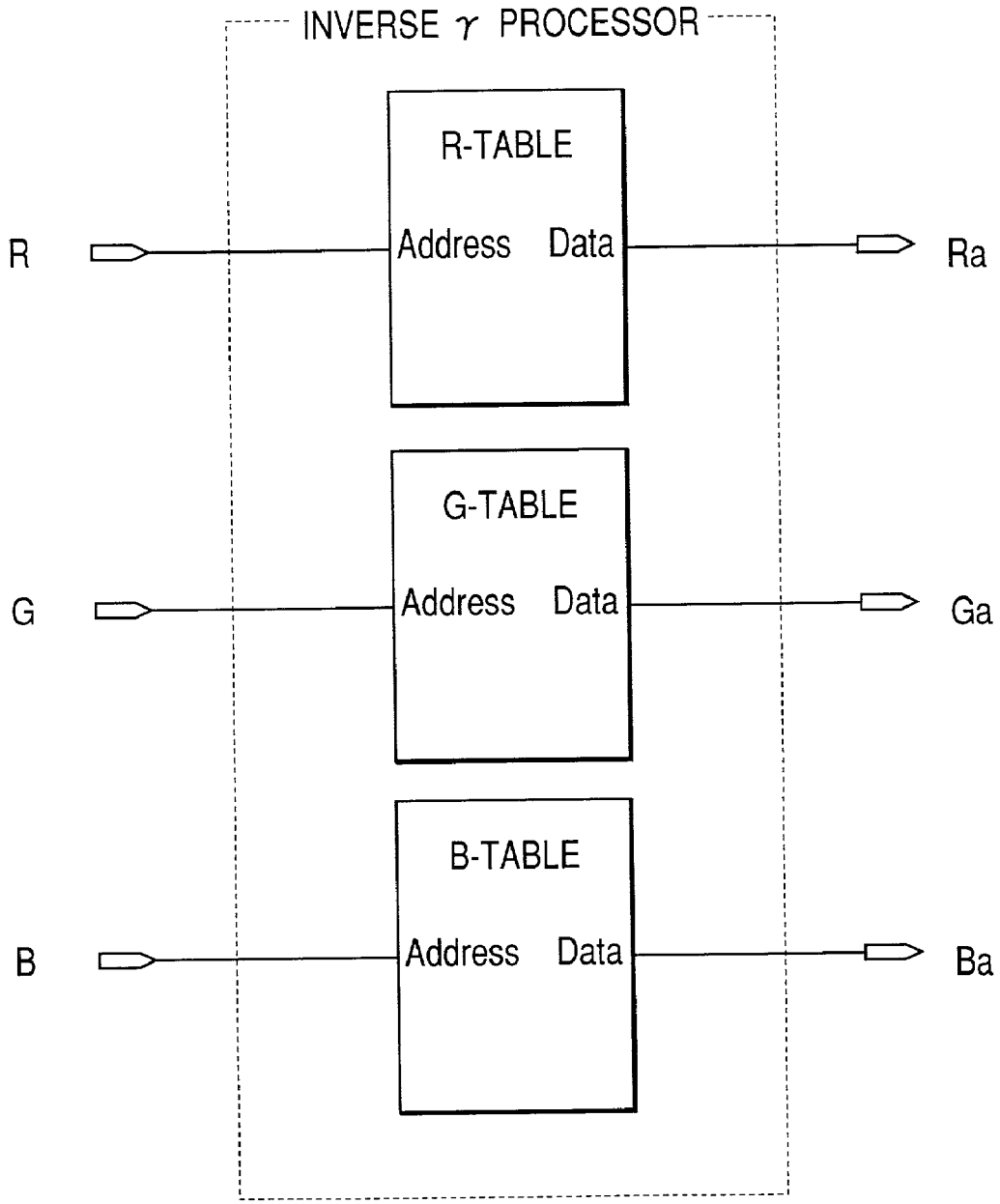
FIG. 15 is a block diagram showing the configuration of an inverse processor of the image display apparatus according to the embodiment of the present invention.

The inverse γprocessor sets the number of bits of picture signals R, G, B to 8 bits and the number of bits of the picture signals Ra, Ga, Ba that are the output of the inverse γprocessor is set to 8 bits in the same manner. The inverse γprocessor is constructed by using address 8-bit and data 8-bit memories every color (FIG. 15).

Figure 16A:
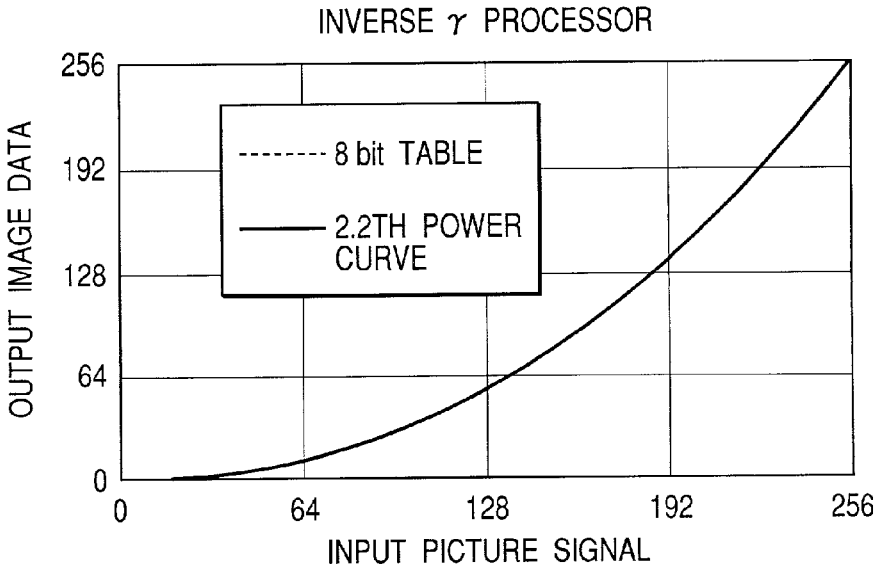
FIGS. 16A and 16B are drawings showing input and output characteristics of the inverse processor of the image display apparatus according to the embodiment of the present invention.
Figure 16B:
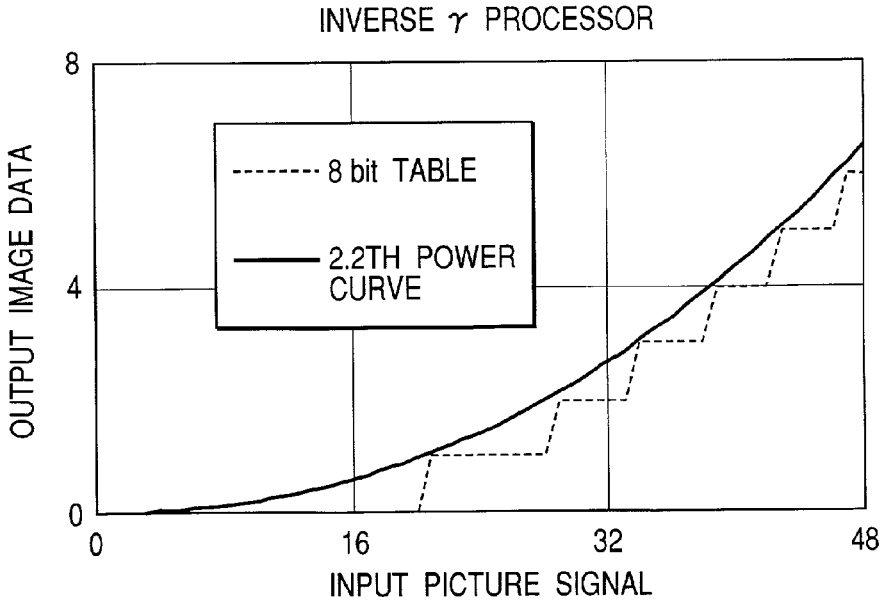

Each memory stored the inverse γcharacteristic described in FIG. 16. Besides, the same FIG. 16A shows the data the input picture signal of this conversion table describes in the table within the range of 0 to 255. Further, the same FIG. 16B shows the input picture data by enlarging the range of 0 to 48.

(Data Alignment Conversion Unit)

Figure 17:
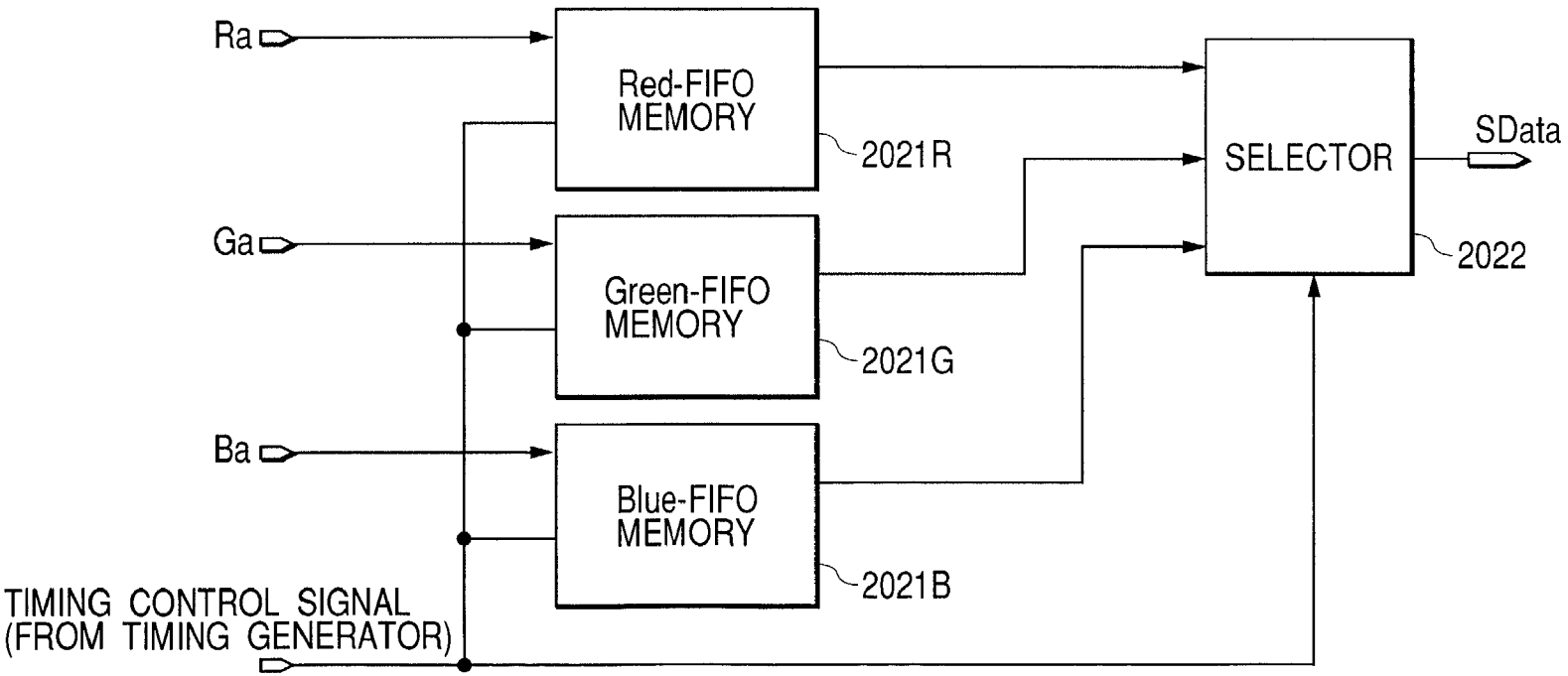
FIG. 17 is a block diagram showing the configuration of a data alignment conversion unit of the image display apparatus according to the embodiment of the present invention.

The data alignment conversion unit 9 is a circuit that converts Ra, Ga, Ba that are RGB-parallel picture signals matching the pixel alignment of the display panel. The configuration of the data alignment conversion unit 9 is composed of FIFO (First In First Out) memories 2021R, 2021G, 2021B every RGB color and a selector 2022 as shown in FIG. 17.

Although not shown in the same drawing, the FIFO memories are two memories of the number of horizontal pixels word for odd-numbered and even-numbered lines. When the picture data of the odd-numbered line is input, data is written in the FIFO for the odd-numbered line. On the other hand, the image data accumulated at the horizontal scan period before one is read from the FIFO memory for the even-numbered line. When the picture data of the even-numbered line is input, data is written in the FIFO for the even-numbered line. On the other hand, the image data accumulated at the horizontal scan period before one is read from the FIFO memory for the odd-numbered memory.

The data read from the FIFO memory is converted in parallel/serially in accordance with the pixel alignment of the display panel by the selector and output as the serial image data SData of the RGB. Although the details are not described, the data alignment conversion unit operates based on the timing control signal from the timing generator 4.

(Adder 12)

The adder 12 adds the adjusted data CD from the adjusted data calculation unit and image data Data. The image data Data is adjusted by performing addition and is transferred to the shift register as the image data Dout.

Besides, when the image data Data and the adjusted data CD are added, an overflow may occur in the adder.

To the contrary, in this example, as one configuration for preventing the overflow is prevented from occurring, the bit width of the adder and the bit width of the subsequent modulator are determined in accordance with the maximum value when the image data Data and the adjusted data CD are added.

More specifically, in the image display apparatus of this example, because the adjusted data is set to up to 120 when the image data consists of all 255 screens, the maximum output value of the adder reaches 255+120=375. Accordingly, the number of bits of each unit is determined assuming that the number of output bits of the adder is set to 9 bits and the number of bits of the modulator is also set to 9 bits.

As another configuration for preventing the overflow from occurring, the maximum value of the adjusted data to be added is previously estimated or the range where image data is exchanged may be decreased previously so that the overflow cannot occur when the maximum value is added.

To decrease the size of exchanging the image data, for example, the input image data ought to be restricted when it is A/D-converted or the size ought to be restricted ny providing a multiplier and multiplying the input image data by a gain of 0 or more and less than 1.

(Delay Circuit 19)

The image data SData of which the rearrangement is performed by a data alignment conversion unit is input to an adjusted data calculation unit and a delay circuit (delay unit) 19. The adjusted data interpolation unit of the adjusted data calculation unit calculates their matched adjusted data CD referring to the horizontal position information x from a timing controller and image data SData.

The delay circuit 19 is provided for absorbing the adjusted data calculation time and a unit for performing a delay so that its corresponding adjusted data can be added correctly to the image data when the adjusted data is added to the image data by the adder. The same unit can be constructed by using a flip-flop.

(Shift Register, Latch)

The image data Dout that is the output of the adjusted data interpolation unit is output to the latch that is converted serially/in parallel from serial data format to parallel data ID1 to IDN every modulation wiring by the shift register 5. The latch latches the data from the shift register with timing signal Dataload immediately before one horizontal interval starts. The output of the latch 6 is supplied to the modulator as parallel image data D1 to DN.

Besides, in this embodiment, the image data ID1 to IDN, D1 to DN are 8-bit image data respectively. These types of operation timing operate based on the timing control signals TSFT and Dataloard from the timing generator 4 (FIG. 13).

(Details of Modulator)

The parallel image data D1 to DN that are the outputs of the latch 6 are supplied to the modulator 8.

Figure 18A:
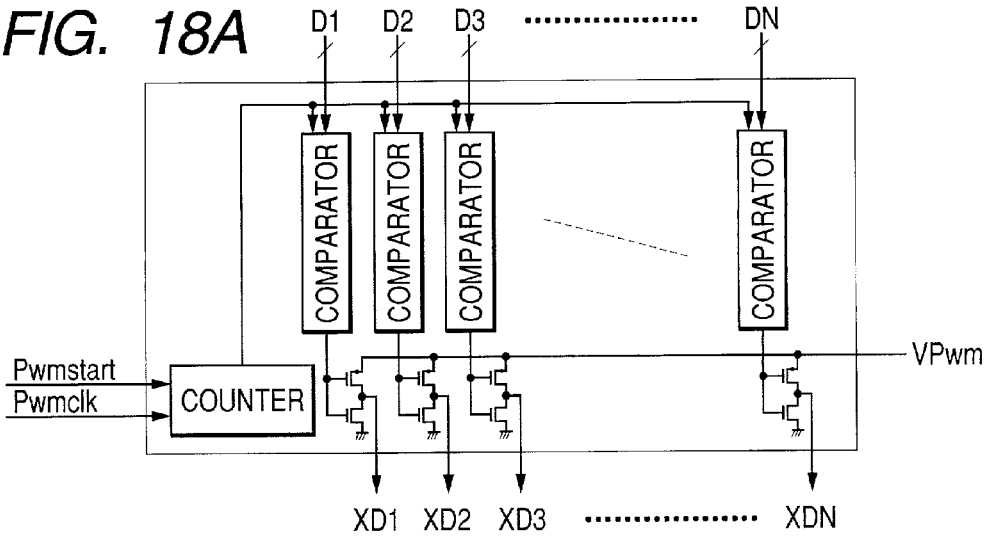
FIGS. 18A, 18B and 18C are drawings for describing the configuration and operation of a modulator of the image display apparatus according to the embodiment of the present invention.

The modulator, as shown in FIG. 18A, is a pulse width modulation circuit (PWM circuit) provided with the PWM counter and comparators and switches (FETs in the same drawing) every modulation wiring.

Figure 18B:
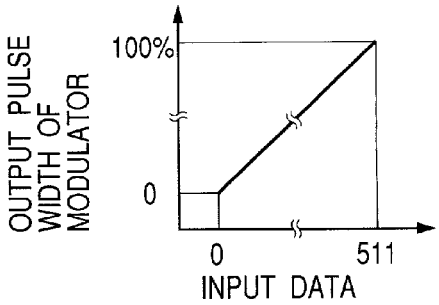

The relationship between the image data D1 to DN and the output pulse width of the modulator has such linear relationship as in FIG. 18B.

Figure 18C:
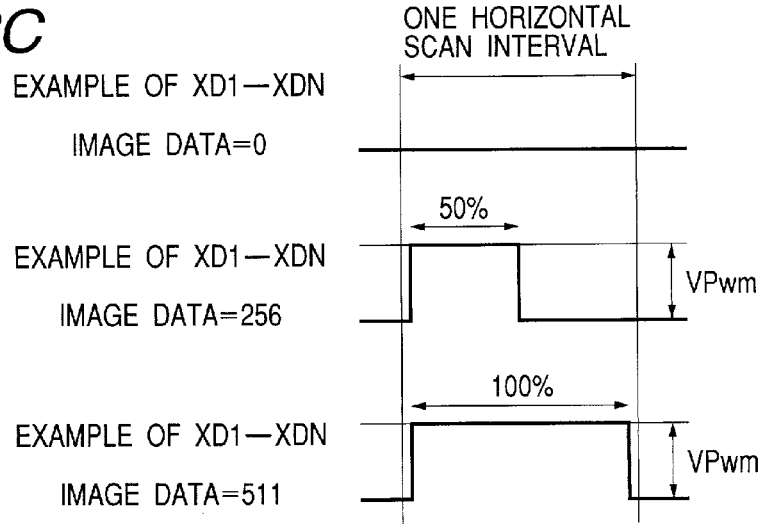

Three examples of the output waveform of the modulator are shown in the same FIG. 18C.

In the same drawing, the upper waveform is a waveform when the input data to the modulator is 0, the central waveform is a waveform when the input data into the modulator is 256, and the lower waveform is a waveform when the input data to the modulator is 511.

Besides, in this example, the number of bits of the input data Dl to DN to the modulator is set to 9 bits considering that no overflow occurs, as described previously.

Besides, in the aforementioned explanation, when the input data to the modulator is 511, there is a place where it is described that the modulation signal of the pulse width that corresponds to one horizontal scan interval is output. Speaking in details, the modulator is let to have timing to spare by providing a period in which it is not driven before a pulse rises and after it falls though the period is an extremely short time as shown in the same FIG. 18C.

Figure 19:
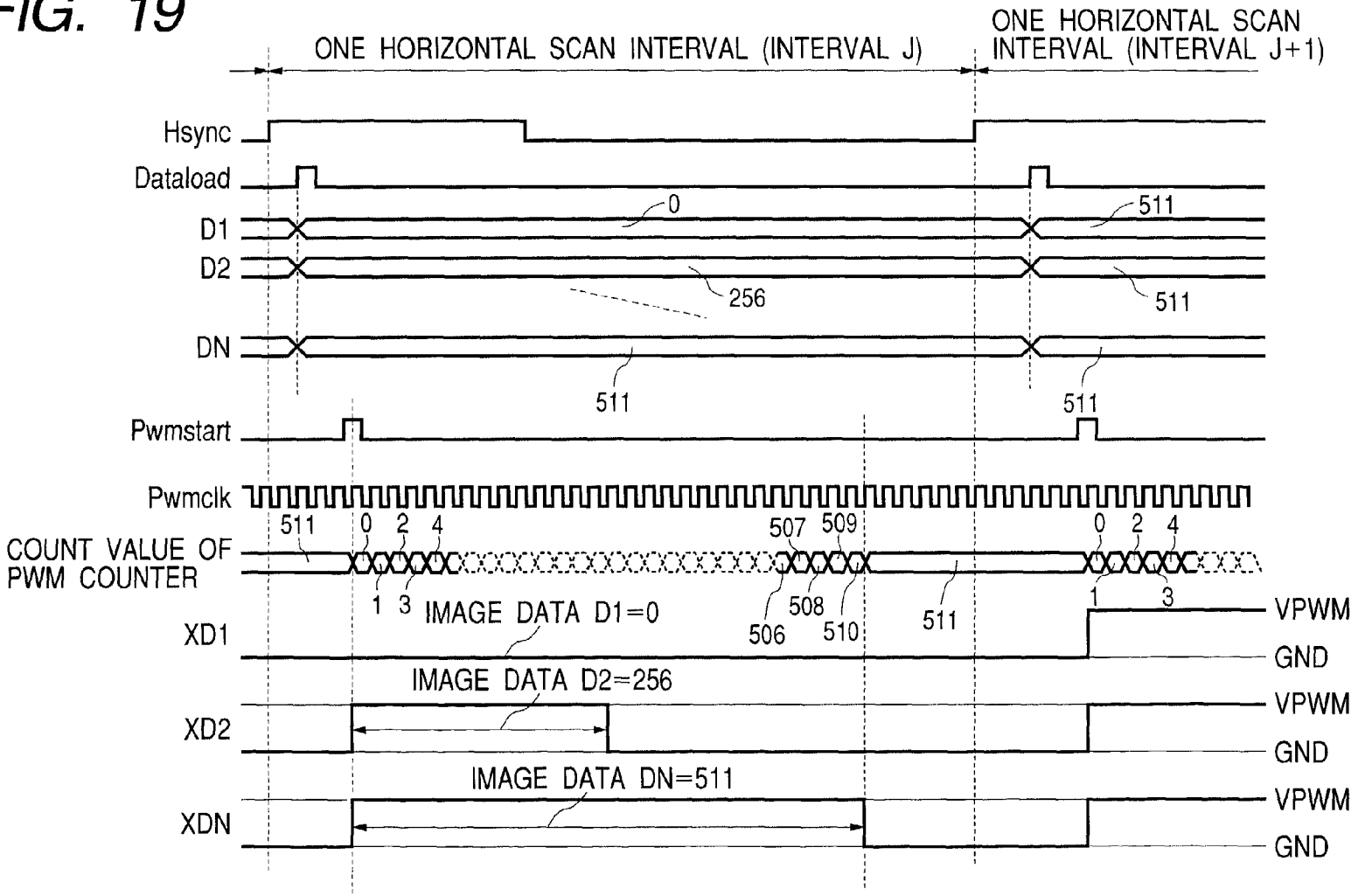
FIG. 19 is a timing chart of the modulator of the image display apparatus according to the embodiment of the present invention.

FIG. 19 is a timing chart showing the operation of the modulator of the present invention.

In the same drawing, Hsync horizontal sync signal Dataload is a load signal to the latch 6 and D1 to DN are input signals to the columns 1 to N of the aforementioned modulator. Pwmstart is a sync clear signal of the PWM counter and Pwmclk is a clock of the PWM counter. Further, XD1 to XDN represent the outputs of the 1st to N-th columns of the modulator.

As shown in the same drawing, when the one horizontal scan interval starts, the latch 6 latches the image data and transfers the data to the modulator.

The PWM counter starts counting based on Pwmstart, Pwmclk. When the count value reaches 511, the count is stopped and the count value 511 is held.

The comparator provided every column compares the count value of the PWM counter and the image data of each column. When the value of the PWM counter exceeds the value of image data, High is output and Low is output at other periods.

The output of the comparator is connected to the gate of each column switch. When the output of the comparator is at the Low period, the upper (VPWM side) switch of the same drawing is set to ON and the lower (GND side) switch is set to OFF. The modulation wiring is connected to the voltage VPWM.

On the contrary, when the output of the comparator is at the High period, the upper switch of the same drawing is set to OFF and the lower switch is set to ON. Simultaneously, the modulation wiring voltage is connected to the GND potential.

When each unit operates as described above, the pulse width modulation signal that the modulator outputs forms a waveform of which the pulse leading edge synchronized, as shown in D1, D2, DN of FIG. 19.

(Adjusted Data Calculation Unit)

Figure 20:
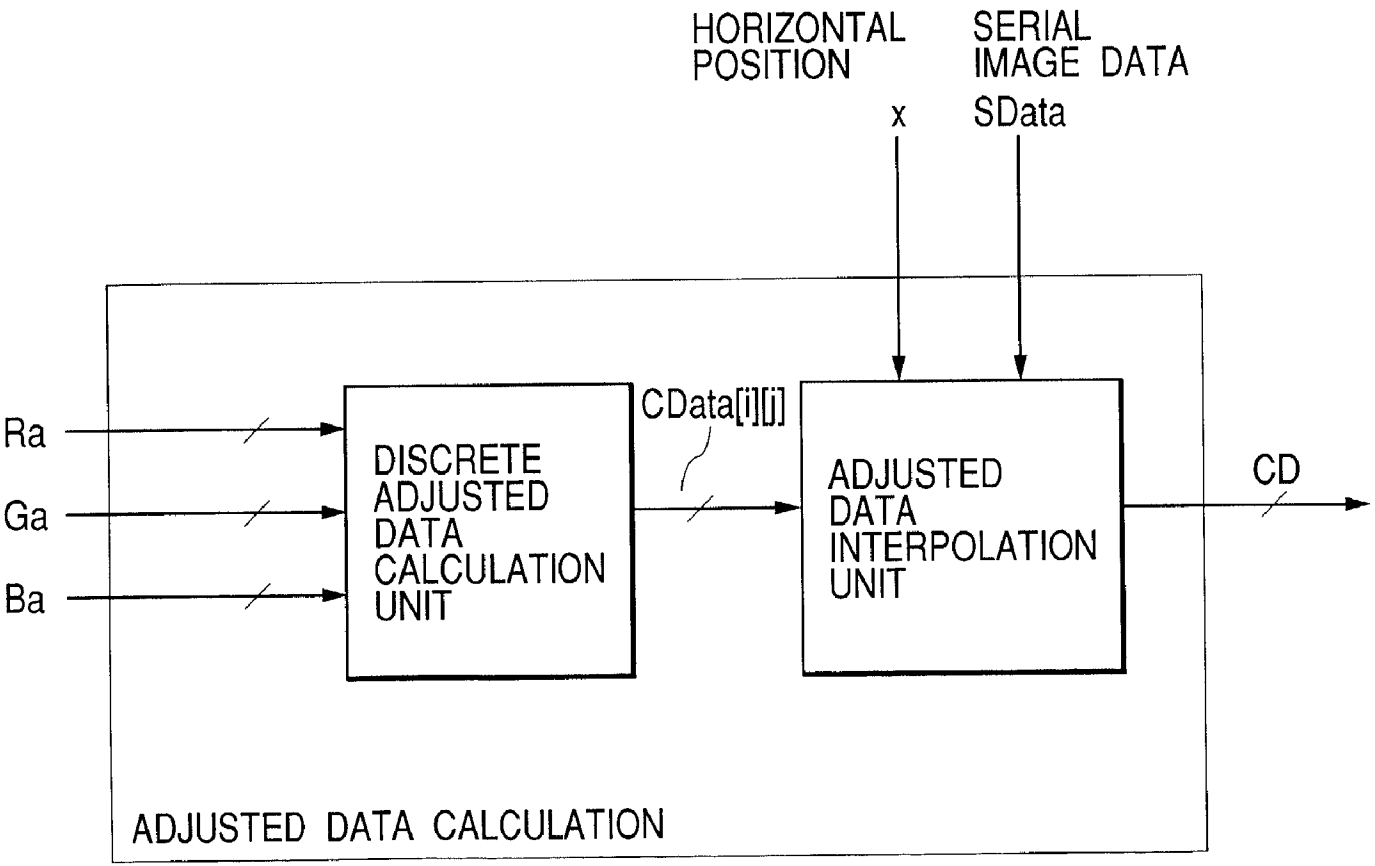
FIG. 20 is a block diagram showing the configuration of an adjusted data calculation unit of the image display apparatus of the present invention.

The adjusted data calculation unit calculates the adjusted data of the voltage drop according to the aforementioned adjusted data calculation method. The adjusted data calculation unit consists of two blocks of the discrete adjusted data calculation unit and the adjusted data interpolation unit as shown in FIG. 20.

The discrete adjusted data calculation unit calculates the voltage drop amount from the input picture signal and discretely calculates the adjusted data from the voltage drop amount. The unit introduces the idea of the aforementioned degradation model and discretely calculates the adjusted data to decrease the computational complexity and the amount of hardware.

The discretely calculated adjusted data is interpolated by the adjusted data interpolation unit (adjusted data interpolation means) and the size of image data and the adjusted data CD that matches the horizontal display position x is calculated.

(Discrete Adjusted Data Calculation Unit)

Figures 21A, 21B:
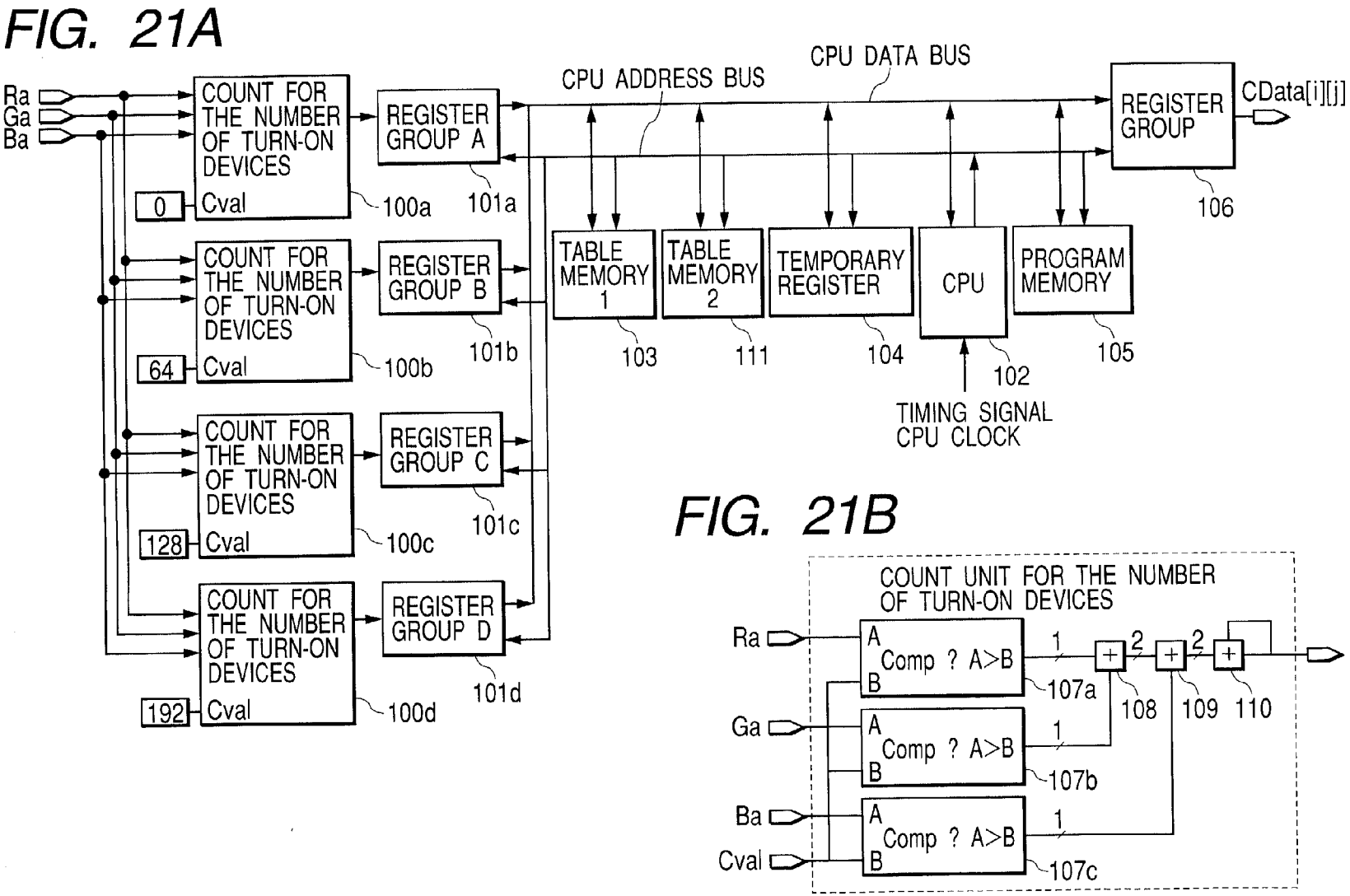
FIGS. 21A and 21B are block diagrams showing the configuration of a discrete adjusted data calculation unit of the image display apparatus of the present invention.

FIGS. 21A and 21B are the discrete adjusted data calculation unit that calculates the discrete adjusted data of the present invention.

The discrete adjusted data calculation unit, as described below, splits image data into blocks and calculates statistics (number of turn-on devices) every block. At the same time, the discrete adjusted calculation unit has the function as a voltage drop amount calculation unit that calculates the time change of the voltage drop amount in each node position from the statistics, the function that converts the voltage drop amount for each time into an emission brightness amount, and the function that integrates then emission brightness amount in the time direction and calculates the total emission brightness amount. Subsequently, the unit calculates the adjusted data for the reference value of the image data from them in a discrete reference point.

In the same drawing, 100*a* to 100*c* are number of turn-on devices count units and 101*a* to 101*c* are register groups that store the number of turn-on devices in each time every blocks. 102 is a CPU and 103 is a table memory (voltage drop amount storage unit) for temporarily storing the parameter aij described in Formulas 2 and 3. 104 is a temporary register for temporarily storing a calculation result and 105 is a program memory in which a CPU program is stored. 111 is a table memory to which conversion data of which the voltage drop amount is converted to the emission current amount is written and 106 is a register group for storing the calculation result of the aforementioned discrete adjusted data.

The number of turn-on devices count units 100*a* to 100*c* consist of the comparators and the adder described in the same FIG. 21B. The picture signals Ra, Ga, Ba are input to the comparators 107*a* to c respectively and compared sequentially with a value of Cval.

Besides, Cval corresponds to the reference value set the aforementioned image data.

The comparators 107*a* to c compare Cval and the image data. If the image data is large, High is output, and if it is small, Low is output.

The outputs of the comparators are mutually added by the adders 108 and 109. Moreover, addition is performed every block by the adder 110 and the addition result every block is stored into register groups 101*a* to c as the number of turn-on devices every block. Specifically, the addition result is cleared at the head of the block for the input data and transferred to the register at the end of the block. The comparator repeats this clearing and the transfer only for the number of clocks.

The number of turn-on devices count units 100*a* to c input 0, 64, 128, 192 respectively as the comparison value Cval of the comparator.

As a result, the number of turn-on devices count unit 100*a* counts the number of image data items that are higher than 0 among the image data and stores the statistics every the block in register 101*a*.

Similarly, the number of turn-on devices count unit 100*b* counts the number of image data items that are higher than 64 among the image data and stores the statistics every the block in register 101*b*.

Similarly, the number of turn-on devices count unit 100*c* counts the number of image data items that are higher than 128 among the image data and stores the statistics every the block in register Similarly, the number of turn-on devices count unit 100*d* counts the number of image data items that are higher than 192 among the image data and stores the statistics every the block in register When the number of turn-on devices is counted every block and every time, the CPU occasionally reads the parameter table aij stored in the table memory 103, calculates the voltage drop amount in accordance with Formulas 2 to 5, and stores the calculation result in the temporary register 104.

In this example, the production-sum operation function for smoothly performing the calculation of Formula 2 is provided in the CPU.

As means for implementing the operation listed in Formula 2, the CPU needs not to perform the production-sum operation. For example, the calculation result may also be stored in the memory.

That is, the number of turn-on devices of each block is assumed as input and the voltage drop amount of each node position may also be stored in the memory for all input patterns to be considered.

As soon as the calculation of the voltage drop amount is calculated, the CPU reads the voltage drop amount of each time and each block, converts the voltage drop amount to the emission current amount referring to the table memory 2 (111), and calculates the discrete adjusted data in accordance with Formulas 6 to 16.

The calculated discrete adjusted data is stored in the register group 106.

(Adjusted Data Interpolation Unit)

The adjusted data interpolation unit calculates the display position (horizontal position) of image data and the adjusted data that matches the size of the image data. The same unit calculates the display position (horizontal position) of the image data and the adjusted data in accordance with the size of the image data by interpolating the discretely calculated adjusted data.

Figure 22:
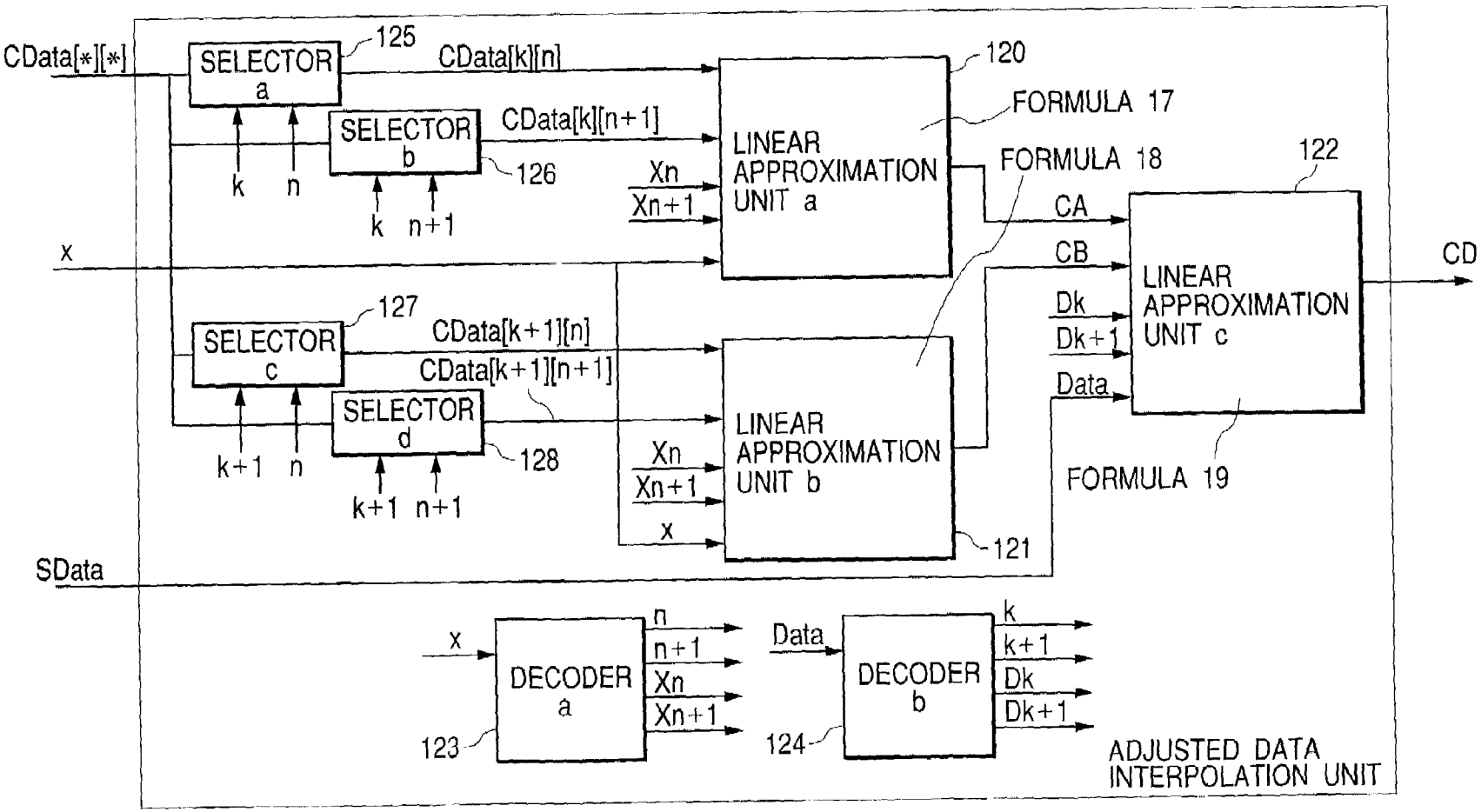
FIG. 22 is a block diagram showing the configuration of an adjusted data interpolation unit according to the embodiment of the present invention.

FIG. 22 is a drawing for describing the adjusted data interpolation unit.

In the same drawing, 123 is a decoder for determining node numbers n and n+1 of the discrete adjusted data used for interpolation from the display position (horizontal position) x of the image data, and 124 is a decoder for determining k and k+1 of Formulas 17 to 19 from the size of the image data.

Selectors 125 to 128 select discrete adjusted data and supply it to a linear approximation unit.

121 to 123 are the linear approximation units for performing the linear approximation of Formulas 17 to 19 respectively.

Figure 23:
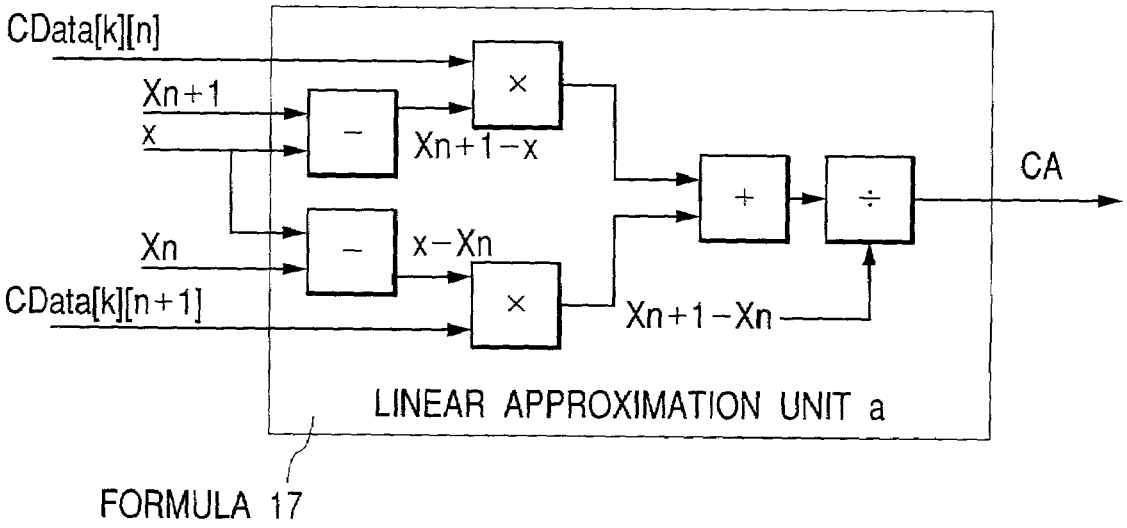
FIG. 23 is a block diagram showing the configuration of a linear approximation unit according to the embodiment of the present invention.

FIG. 23 shows a configuration example of the linear approximation unit 121. In general, a linear approximation unit can be composed of a subtracter, an integrator, an adder, and a division device, as shown in the operators of Formulas 17 to 19.

However, there is an advantage that hardware can be constructed extremely simply if it is constructed so that the number of inter-node column wirings of the node that calculates the discrete adjusted data and the interval (that is a time interval at which the voltage drop is calculated) of the image data reference value from which the discrete adjusted data is calculated can be set to the power of 2. If they are set to the power of 2, in the division device shown in FIG. 23, Xn+1−Xn is set to the power of 2 and a bit shift circuit may be used.

If the value of Xn+1−Xn is always a fixed value and a value represented in the power of 2, the addition result of the adder may be shifted and output only for the multiplier of the power and a division device needs not to be manufactured.

Even in other places, by setting the interval of the node at which discrete adjusted data is calculated and the interval of image data to the power of 2, there are extremely many advantages, for example, the decoders 123 to 124 can simply be manufactured and the operation performed by the subtracter of FIG. 23 can be substituted for simple bit operation.

(Each Unit Operation Timing)

Figure 24:
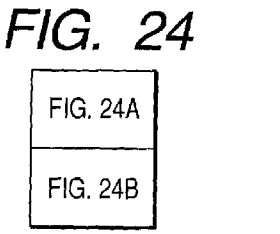
FIG. 24 is comprised of FIGS. 24A and 24B showing timing charts of the image display apparatus according to the embodiment of the present invention.
Figure 24A:
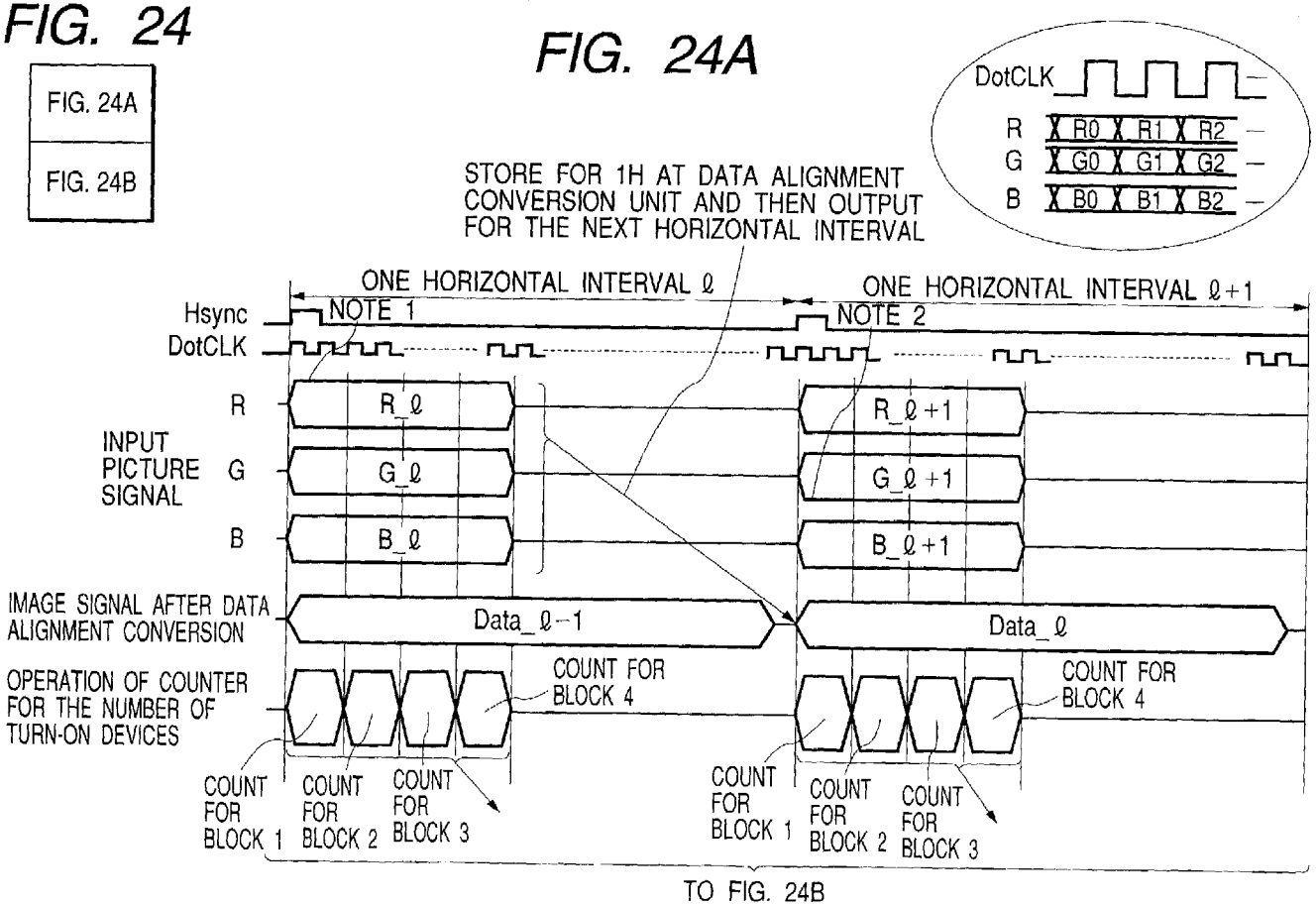
Figure 24B:
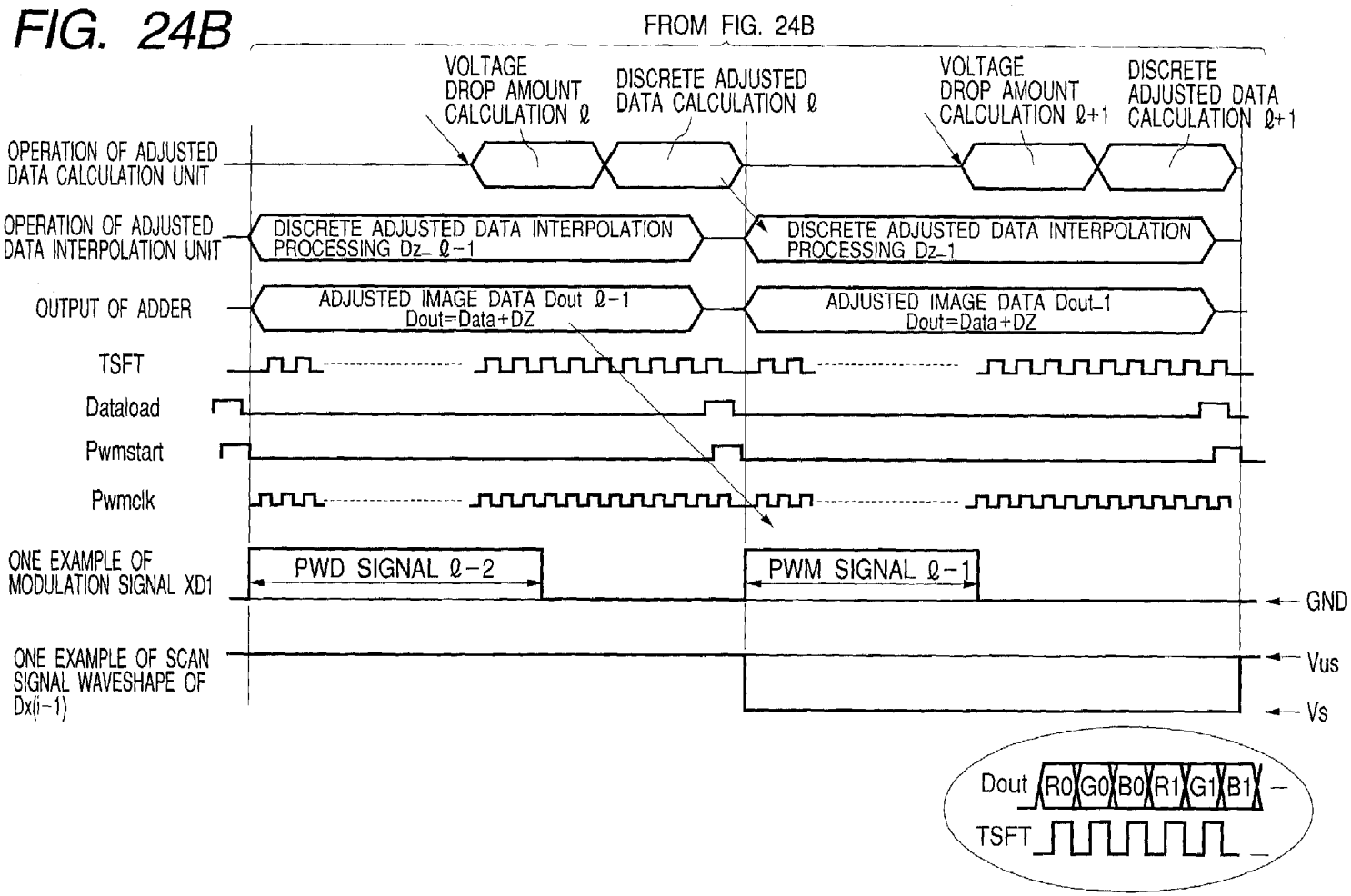

FIGS. 24A and 24B show timing charts of the operation timing of each unit.

Besides, in the same drawing, Hsync is a horizontal sync signal and DotCLK is a clock created from the horizontal sync signal H sync via the PLL circuit in the timing generator. R, G, B are the digital image data from the input switching circuit and Data is the image data after data alignment conversion. Dout is the image data to which the voltage drop is adjusted and TSFT is a shift clock for transferring the image data Dout to the shift register 5. Dataload a load pulse for latching the data to the latch circuit 6 and Pwmstart is the start signal of the aforementioned pulse width modulation and the modulation signal XD1 is an example of the pulse width modulation signal supplied to the modulation wiring 1.

Along with the start of one horizontal interval, digital image data RGB is transferred from the input switching circuit. In the same drawing, at horizontal scan interval I, when the input image data is represented in R_I, G_I, B_I, they are accumulated as the image data in the data alignment conversion unit 9 during one horizontal interval and output as digital image data Data_I matching the pixel alignment of the display panel at horizontal scan interval I+1.

R_I, G_I, B_I are input to the adjusted data calculation unit at the horizontal scan interval I. The same unit counts the aforementioned number of turn-on devices and calculates the voltage drop amount along with the end of count.

When the voltage drop amount is calculated, subsequently, the discrete adjusted data is calculated and the calculation result is stored in the register.

At the scan interval I+1, the image data Data_I before one horizontal scan interval is output from the data alignment conversion unit. Synchronizing with this output, in the adjusted data interpolation unit, the discrete adjusted data is interpolated and the adjusted data is calculated. The interpolated adjusted data is immediately converted for the number of graduations by the number of graduations conversion unit 15 and supplied to the adder 12.

The adder 12 sequentially adds the image data Data and adjusted data CDz and transfers the adjusted image data Dout to the shift register. The shift register stores the image data Dout for one horizontal interval in accordance with Tsft, performs serial-to-parallel conversion, and outputs the parallel image data ID1 to IDN to the latch 6. The latch 6 latches the parallel image data ID1 to IDN from the shift register in accordance with the leading edge of Dataload and transfers the latched image data D1 to DN to the pulse width modulator 8.

The pulse width modulator 8 outputs the pulse width modulation signal of the pulse width that matches the latched image data. In the image display apparatus of this embodiment, consequently, the pulse width that the modulator outputs is displayed for the input image data delayed at two horizontal scan intervals.

When an image is displayed by such image display apparatus, the voltage drop amount in the scan wiring that is the conventional problem is able to be adjusted, the deterioration of the display image resulting from it is able to be improved, and the extremely good image is able to be displayed.

The adjusted data can be calculated extremely simply by discretely calculating the adjusted data and interpolating and obtaining it between discretely calculated points. Further, there is an extremely excellent effect such as the calculation can be implemented using extremely simple hardware.

(Node Position and Desirable Setting Interval of Image Data Reference Value)

In the aforementioned example, to simplify the explanation, an example in which the block is split into four is shown. The node that is the position where the voltage drop amount and discrete adjusted data are calculated is represented in the five points of the block boundary position. To calculate the adjusted data with good accuracy, however, as the number of blocks and the number of nodes increase, this method is desirable because the error due to the aforementioned linear approximation decreases. On the contrary, needless to say, the computational complexity increases.

On the other hand, as the method of decreasing an error in the limited number of blocks, the number of nodes, and the error, it is desirable that the intervals of the block and node should be set finely at the place where the changes of the voltage drop amount and the adjusted data are great. On the contrary, it is desirable that the interval at which the block and node are set should be made coarse. Setting the node and block in this manner is desirable in the point that even when the aforementioned linear approximation is performed, the error can be decreased and the adjusted data can be calculated in little computational complexity.

Figure 25A:
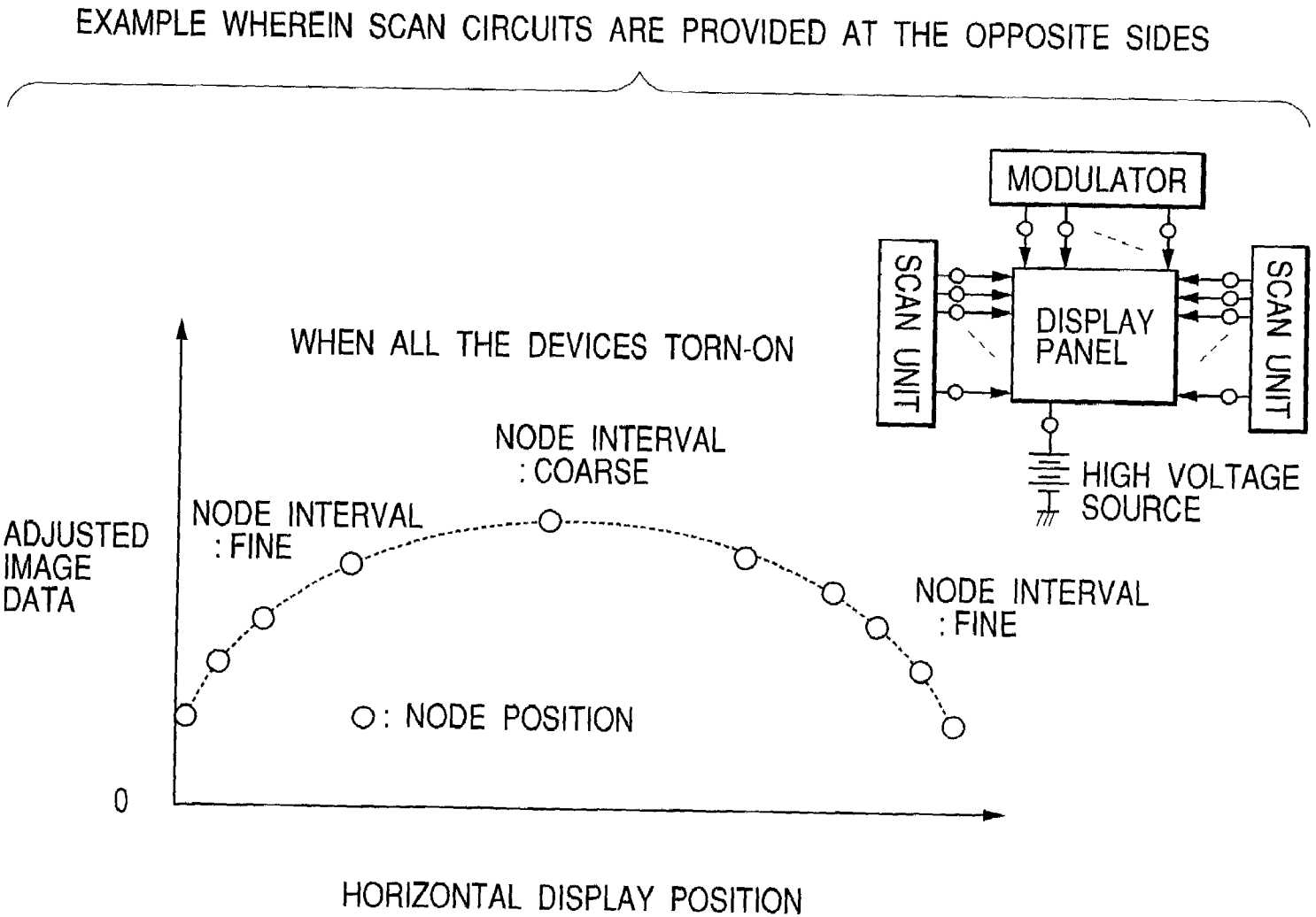
FIGS. 25A and 25B are drawings for describing a node setting interval according to the embodiment of the present invention.

FIG. 25A is an example of the calculation result in which the adjusted image data is calculated when all the devices turn-on in the case wherein scan circuits are provided at the opposite sides.

As an ideal calculation result, it is desirable that the adjusted data should be calculated as the curve that exists in the dotted line of the same drawing. In the present invention, the adjusted data is calculated by performing degradation. Accordingly, in actual, the discrete adjusted data is calculated in the node position described with the circle mark of the drawing and in the intermediate position, the adjacent nodes and the adjusted image data of the node are linearly approximated and calculated, which is described above.

In this case, when the node position is nearer to both the left and right ends of the screen with the large gradient of the dotted point of FIG. 25A, if the node setting interval is set finely and the node setting interval at the center of the screen is made coarse, the calculation error can be decreased by performing linear interpolation in the limited computational complexity, which is desirable.

Figure 25B:
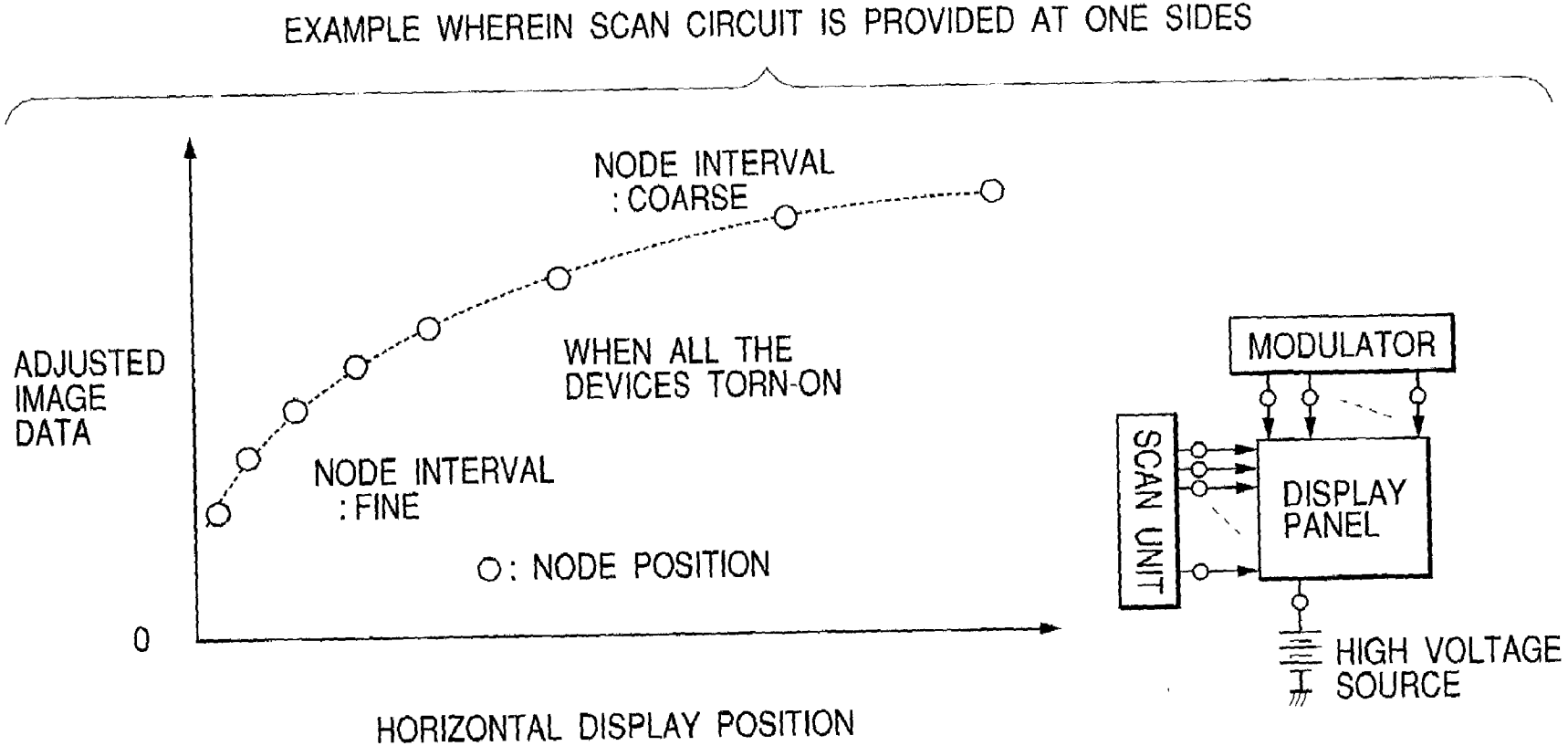
Figure 26:
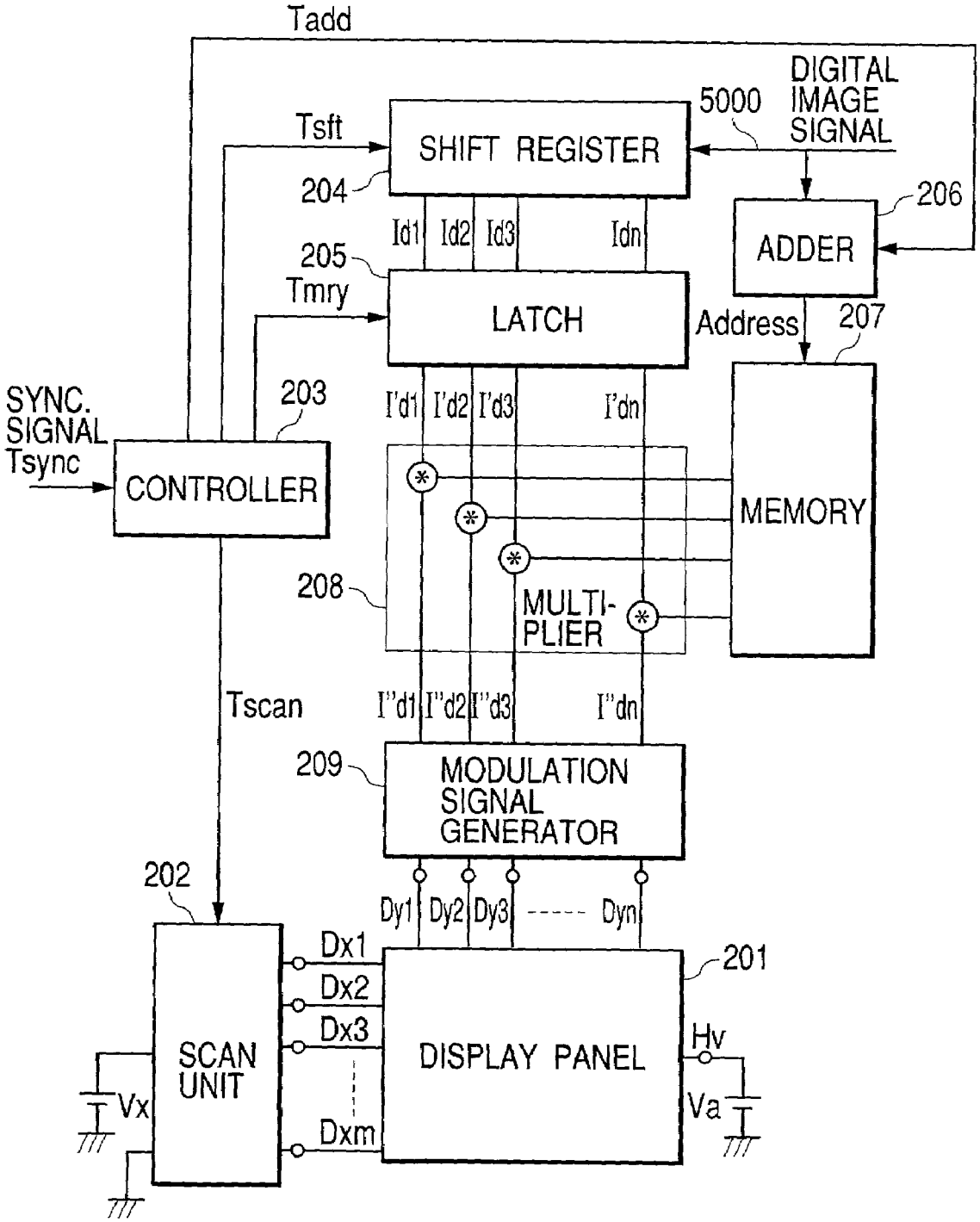
FIG. 26 is a block diagram showing the configuration of the conventional image display apparatus.

FIG. 25B is an example of the calculation result from which the adjusted image data is calculated when all the devices turn on if a scan circuit is provided at one side.

Even in such a case, calculation can be performed in little computational complexity and with good accuracy by making the node setting interval fine at the left (at the side of the scan circuit is provided) of the screen with a great change and making the block and node setting intervals coarse at the right (at the side of the scan circuit is not provided), which is desirable.

Besides, also in this case, needless to say, it is desirable that the adjacent nodes and the node interval should be selected to the power of 2 because the hardware amount in the interpolation unit can be reduced.

It is desirable that the aforementioned interval at which the image data reference value should be set according to the size of image data as follows.

At the place where image data is small in particular, because the size of the image data itself is small, there is a characteristic that the influence due to the error when the adjusted data is calculated is easy to stand out. On the contrary, at the place where the size of the image data is great, because the size itself of the image data is great, the influence due to the error when the adjusted data is calculated is difficult to stand out.

From the standpoint of considering such characteristic and decreasing an adjustment error, in the area where the image data is small, it is desirable that the interval at which the image data reference value should be set finely. On the contrary, in the area where the size of the image data is great, it is desirable that the interval at which the image data reference value is set should be set coarsely.

More specifically, the inventors calculated adjusted data by selecting 0, 2, 4, 6, 8, 16, 32, 48, 64, 96, 128, 192 and 256 as the image data reference values, which is extremely desirable.

Furthermore, even in this case, because the hardware of the interpolation circuit for performing calculation can be reduced (the division device can be substituted for a bit shift circuit) by selecting the interval with the adjacent image data reference values to the power of 2, this is extremely desirable.

Second Embodiment

In the first embodiment, the discrete image data reference value is set for the input image data and a reference point is set on the row wiring. Subsequently, the adjusted data for the image data of the size of the image data reference value in the reference point is calculated.

The horizontal display position of the input image data and the adjusted data that matches the size are calculated by interpolating the discretely calculated adjusted data, and the adjustment is realized by adding the image data to them.

On the other hand, unlike the aforementioned configuration, the same adjustment can also be performed in the following configuration.

The discrete horizontal position and the adjustment result of the image data for the image data reference value (that is, sum of the discrete adjusted data and the image data reference value: that is, adjusted image data) are calculated. Further, the discretely calculated adjustment result is interpolated and the horizontal display position of the input image data and the adjustment result that matches the size are calculated. Then modulation may be performed in accordance with the adjustment result.

In this configuration, at discrete calculation, because the adjusted image data is calculated as a result of calculation of both the data, the adjusted image data and the adjusted data need not to be added.

(Effect of the Invention)

As described above, according to the image display apparatus of the present invention, the deterioration of the display image due to the voltage drop on the scan wiring that is the conventional problem is able to be improved.

There are extremely excellent effects that the adjustment amount of the image data for adjusting the voltage drop by introducing several approximations and the calculation can be realized using extremely simple hardware.

There is an excellent effect that a sense of incompatibility of the display image can also be reduced.

What is claimed is:

1. An image display apparatus, comprising:

an image-forming device that is arranged in a matrix, driven via a plurality of row and column wirings, and used to form an image;

a scan unit that sequentially selects and scans said row wiring;

an adjusted image data calculation unit that calculates adjusted image data for decreasing an influence of a voltage drop resulting from at least the resistance component of said row wiring for image data; and a modulator that outputs a modulation signal applied to said column wiring based on said adjusted image data, wherein said adjusted image data calculation unit comprises a discrete adjusted image data calculation unit that sets a plurality of discrete image data reference values for image data and calculates discrete adjusted image data for said image data reference value, and an adjusted image data interpolation unit that interpolates the output of the discrete adjusted image data calculation unit and adjusted image data that corresponds to the size of the image data, wherein said discrete adjusted image data calculation unit splits the one horizontal scan interval into a plurality of time areas corresponding to said image data reference value, expands the respective time areas so that the total amount of the emission brightness amount emitted in the respective time areas can be made equal when no influence of the voltage drop takes place, integrates an expanded result of the respective time areas, and calculates said discrete adjusted image data.

2. The image display apparatus according to claim 1, wherein said discrete adjusted image data calculation unit approximates to the case where the emission brightness amount in the boundary of said time areas will not change by performing expansion when said time areas are expanded and calculates the expansion amount of the respective time areas.

3. An image display apparatus, comprising:

an image-forming device that is arranged in a matrix, driven via a plurality of row and column wirings, and used to form an image;

a scan unit that sequentially selects and scans said row wiring;

an adjusted image data calculation unit that calculates adjusted image data for decreasing an influence of a voltage drop resulting from at least the resistance component of said row wiring for image data; and a modulator that outputs a modulation signal applied to said column wiring based on said adjusted image data, wherein said adjusted image data calculation unit comprises a discrete adjusted image data calculation unit that sets a plurality of discrete image data reference values for image data and calculates discrete adjusted image data for said image data reference value, and an adjusted image data interpolation unit that interpolates the output of the discrete adjusted image data calculation unit and outputs the adjusted image data, wherein said discrete adjusted image data calculation unit splits the data range of the image data into a plurality of areas corresponding to said image data reference value, expands the respective areas so that the total amount of the emission brightness amount emitted for the respective areas can be made equal when no influence of the voltage drop takes place, integrates an expanded result of the respective areas, and integrates said discrete adjusted image data.

4. The image display apparatus according to claim 3, wherein said discrete adjusted image data calculation unit approximates to the case where the emission brightness amount in the boundary of said areas will not change by performing expansion when said areas are expanded and calculates the expansion of the respective areas.

5. An image display apparatus, comprising:

an image-forming device that is arranged in a matrix, driven via a plurality of row and column wirings, and used to form an image;

a scan unit that sequentially selects and scans said row wiring;

an adjusted image data calculation unit that calculates adjusted image data for decreasing an influence of a voltage drop resulting from at least the resistance component of said row wiring for image data;

an operation unit that operates said adjusted data and said image data; and a modulator that outputs a modulation signal applied to said column wiring corresponding to the output of said operation unit, wherein said adjusted image data calculation unit comprises a discrete adjusted image data calculation unit that sets a plurality of discrete image data reference values for said image data and calculates the discrete adjusted image data for said image data reference value, and an adjusted image data interpolation unit that interpolates the output of the discrete adjusted image data calculation unit and calculates the adjusted image data that corresponds to the size of said image data, wherein said discrete adjusted image data calculation unit splits the one horizontal scan interval into a plurality of time areas corresponding to said image data reference value, expands the respective time areas so that the total amount of the emission brightness amount emitted in the respective time areas can be made equal when no influence of the voltage drop takes place, integrates an expanded result of the respective time areas, and calculates said discrete adjusted image data.

6. The image display apparatus according to claim 5, wherein said discrete adjusted image data calculation unit approximates to the case where the emission brightness amount in the boundary of said time areas will not change when said time areas are expanded, and calculates the expansion amount of the respective time areas.

7. An image display apparatus, comprising:

an image-forming device that is arranged in a matrix, driven via a plurality of row and column wirings, and used to form an image;

a scan unit that sequentially selects and scans said row wiring;

an adjusted image data calculation unit that calculates adjusted image data for decreasing an influence of a voltage drop resulting from at least the resistance component of said row wiring for image data;

an operation unit that operates said adjusted data and said image data; and a modulator that outputs a modulation signal applied to said column wiring corresponding to the output of said operation unit, wherein said adjusted image data calculation unit comprises a discrete adjusted image data calculation unit that sets a plurality of discrete image data reference values for said image data and calculates the discrete adjusted image data for said image data reference value, and an adjusted image data interpolation unit that interpolates the output of the discrete adjusted image data calculation unit and calculates the adjusted image data that corresponds to the size of said image data, wherein said discrete adjusted image data calculation unit splits the data range of the image data into a plurality of areas corresponding to said image data reference value, expands the respective areas so that the total amount of the emission brightness amount emitted for the respective areas can be made equal when no influence of the voltage drop takes place, integrates an expanded result of the respective areas, and integrates said discrete adjusted image data.

8. The image display apparatus according to claim 7, wherein said discrete adjusted image data calculation unit approximates to the case where the emission brightness amount in the boundary of said areas will not change when said areas are expanded and calculates the expansion amount of the respective areas.

* * * * *

UNITED STATES PATENT AND TRADEMARK OFFICE

CERTIFICATE OF CORRECTION

PATENT NO. : 7,079,161 B2
APPLICATION NO. : 10/164400
DATED : July 18, 2006
INVENTOR(S) : Osamu Sagano et al.

It is certified that error appears in the above-identified patent and that said Letters Patent is hereby corrected as shown below:

SHEET 13

FIG. 12A , “ADJUSED” should read --ADJUSTED--; and
FIG. 12B, “ADJUSED” should read --ADJUSTED--.

SHEET 14

FIG 13, “FIGUIRING” should read --FIGURING--.

SHEET 27

FIG 25A, “TORN-ON” should read --TURN-ON--.

SHEET 28

FIG. 25B, “TORN-ON” should read --TURN-ON--; and “SIDES” should read --SIDE--.

COLUMN 3

Line 25, “processor,” should read --γ processor--; and
Line 28, “processor,” should read --γ processor--.

COLUMN 7

Line 45, “complicate,” should read --complicated,--.

COLUMN 10

Line 62, “all = b × (rt+ n×r) rl1” should read --all = b × (rt+ n×r) / rl1--.

COLUMN 11

Line 12, “al3 = d × (rt+ n×r) / r13” should read --al3 = d × (rt+ n×r) / rl3--; and
Line 43, “Counti” should read --Count i--.

COLUMN 12

Line 22, “drop” should read --drop at--; and
Line 45, “later” should read --latter--.

UNITED STATES PATENT AND TRADEMARK OFFICE

CERTIFICATE OF CORRECTION

PATENT NO. : 7,079,161 B2
APPLICATION NO. : 10/164400
DATED : July 18, 2006
INVENTOR(S) : Osamu Sagano et al.

It is certified that error appears in the above-identified patent and that said Letters Patent is hereby corrected as shown below:

COLUMN 13

Line 1, “It” should read --it--;
Line 21, “In” should read -- ¶In--; and
Line 50, “slot = = 128” should read --slot = 128--.

COLUMN 14

Line 20, “actual,” should read --actuality,--; and
Line 30, “this” should read --the--.

COLUMN 15

Line 42, “according” should read --according to--.

COLUMN 16

Line 34, “Ie 3” should read --Ie3--;
Line 45, “nede 2” should read --node 2--; and
Line 48, “nede 2” should read --node 2--.

COLUMN 21

Line 3, “ny” should read --by--;
Line 33, “Dataloard” should read --Dataload--; and
Line 53, “Dl” should read --D1--.

COLUMN 22

Line 63, “then” should read --the--.

UNITED STATES PATENT AND TRADEMARK OFFICE

CERTIFICATE OF CORRECTION

PATENT NO. : 7,079,161 B2
APPLICATION NO. : 10/164400
DATED : July 18, 2006
INVENTOR(S) : Osamu Sagano et al.

It is certified that error appears in the above-identified patent and that said Letters Patent is hereby corrected as shown below:

COLUMN 23

Line 18, “107a to c” should read --107a to 107c--;
Line 20, “set” should read --set by--;
Line 22, “107a to c” should read --107a to 107c--;
Line 28, “101a to c” should read --101a to 101c--;
Line 34, “100a to c” should read --100a to 100c--;
Line 40, “every the” should read --at every--;
Line 44, “every the” should read --at every--;
Line 48, “every the” should read --at every--;
Line 49, “register” should read --register 101c--;
Line 52, “every the” should read --at every--; and
Line 53, “register” should read --register 101d.--.

COLUMN 26

Line 24, “actual,” should read --actuality,--.

COLUMN 28

Line 5, “and adjusted image data that corre-” should read --and outputs the adjusted image data,--; and
Line 6, “sponds to the size of the image data,” should be deleted.

Signed and Sealed this

Twenty-ninth Day of May, 2007

JON W. DUDAS
*Director of the United States Patent and Trademark Office*